US005093229A

United States Patent [19]

Yabuki et al.

[11] Patent Number: 5,093,229

[45] Date of Patent: Mar. 3, 1992

[54] HEAT DEVELOPABLE LIGHT-SENSITIVE MATERIAL CONTAINING AN AMIDINE BASED PRECURSOR

[75] Inventors: Yoshiharu Yabuki; Hiroyuki Hirai, both of Kanagawa, Japan

[73] Assignee: Fuji Photo Film Co., Ltd., Kanagawa, Japan

[21] Appl. No.: 236,491

[22] Filed: Aug. 25, 1988

[30] Foreign Application Priority Data

Aug. 25, 1987 [JP] Japan ..... 62-209138

[51] Int. Cl.[5] ..... G03C 1/02

[52] U.S. Cl. ..... 430/617; 430/203; 430/619; 430/955

[58] Field of Search ..... 430/203, 617, 619, 955

[56] References Cited

U.S. PATENT DOCUMENTS 3,493,374 2/1970 Roncken et al. .
4,060,420 11/1977 Merkel et al. .
4,088,496 5/1978 Merkel .
4,560,763 12/1985 Sato et al. .
4,626,500 12/1986 Sato et al. ..... 430/617
4,639,418 1/1987 Yabuki et al. ..... 430/617

FOREIGN PATENT DOCUMENTS 180537 3/1984 Japan .
998949 7/1965 United Kingdom .

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A heat developable light-sensitive material comprising a support having thereon at least one layer containing a base precursor, a light-sensitive silver halide, a binder, and a dye-providing substance which produces or releases a diffusible dye in correspondence or countercorrespondence to the reduction of the light-sensitive silver halide to silver at an elevated temperature, the base precursor comprising a salt of a carboxylic acid and a diacidic, triacidic or tetraacidic organic base comprising a hydrocarbon group or a heterocyclic group substituted with 2 to 4 amidine groups represents by formula (I-2):

(I-2)

wherein $R^{15}$, $R^{16}$ and $R^{17}$ are as defined in the specification. The heat developable light-sensitive material has excellent age preservability and provides a high sensitivity and low-fog image.

17 Claims, No Drawings

HEAT DEVELOPABLE LIGHT-SENSITIVE MATERIAL CONTAINING AN AMIDINE BASED PRECURSOR

FIELD OF THE INVENTION

The present invention relates to a heat developable light-sensitive material. More particularly, the present invention relates to a heat developable light-sensitive material which exhibits excellent age preservability and provides high image density and low fog density.

BACKGROUND OF THE INVENTION

Photography using silver halide has been most widely used because it provides excellent photographic properties, such as sensitivity and gradation, as compared to other methods such as electrophotography and diazo photography. Silver halide photography includes a color diffusion transfer process using light-sensitive element having a silver halide emulsion layer and image-receiving element having an image-receiving layer, laminated with either an alkaline processing composition spread in a layer between the elements, or being immersed in an alkaline processing solution. In recent years a new technique has been developed to easily and rapidly form images. In this process for forming images on a light-sensitive silver halide material, a dry process by heating or like means is used instead of the conventional wet process with a developing solution.

Examples of new color image formation processes by heat development are described in U.S. Pat. Nos. 4,463,079, 4,474,867, 4,478,927, 4,507,380, 4,500,626, 4,483,914, and 4,439,513, JP-A-58-149046, JP-A-59-48764, JP-A-59-65839, JP-A-59-71046, JP-A-59-87450, and JP-A-59-88730 (the term "JP-A" as used herein means an "unexamined published Japanese patent application").

In these processes, a mobile dye is produced or released in correspondence or countercorrespondence to the reduction of a light-sensitive silver halide and/or an organic silver salt to silver by heat development and is then transferred to a dye fixing material.

Examples of a photographic material which can be used in such an image formation process include light-sensitive silver halides as described in JP-A-58-58543, JP-A-58-79247, and JP-A-61-238056, and a combination of a heat developable light-sensitive material containing a dye-providing substance which produces or releases a diffusible dye and a dye fixing material for fixing the dye transferred thereto.

In general, it is desired to provide a high pH in the reaction system for the development of a light-sensitive material, and for this a base is normally used in development.

In a wet image formation process such as the above-described development with a developing solution, such a base is normally incorporated in the processing solution (developing solution). In a simple dry image formation process by heating or like means it is normally necessary that such a base be incorporated in a light-sensitive material. However, such a process is disadvantageous in that if a base is incorporated in the light-sensitive material in an active form, it adversely affects the age stability of the light-sensitive material. For example, the base may adversely affect other components or may itself deteriorate during the storage of the light-sensitive material.

In order to solve these problems, it has been proposed that such a base be replaced by a precursor (base precursor) which is neutral or weakly basic during storage, but can produce a base during image formation. Various heat decomposition type base precursors have been studied and developed. Typical examples of such heat decomposition type base precursors include salts of carboxylic acids and organic bases. Examples of such a base precursor containing a salt of a carboxylic acid and an organic base include a salt of a triazine compound and a carboxylic acid as described in U.S. Pat. No. 3,493,374, trichloroacetate as described in British Patent 998,949, propiolate as described in JP-A-59-180537, and sulfonylacetate as described in JP-A-61-51139 and U.S. Pat. No. 4,060,420. These base precursors are subjected to decarboxylation of the carboxyl group contained in the carboxylic acid on heating. Accordingly, these base precursors are adapted to release an organic base during use (on heating).

In the improvement of such a base precursor, it is very important to attain both stability of the base precursor during storage and rapid decomposition of the base precursor (production of a base) during use. Conventionally, emphasis has been placed on the decarboxylability of the carboxyl group contained in the carboxylic acid to find improved carboxylic acids.

However, these base precursors fail to fully satisfy both requirements, i.e., stability during storage and rapid base production. They are also disadvantageous in that a heat developable light-sensitive material containing such a base precursor exhibits poor preservability and provides a low S/N ratio image density.

SUMMARY OF THE INVENTION

It is therefore an object of the present invention to provide a heat developable light-sensitive material which exhibits excellent age preservability and provides a high-density and low-fog image.

The above described and other objects of the present invention will become more apparent from the following detailed description and examples.

It has now been discovered that these and other objects of the present invention are accomplished with a heat developable light-sensitive material composed of a support having thereon at least one layer containing a base precursor, a light-sensitive silver halide, a binder, and a dye-providing substance which produces or releases a diffusible dye in correspondence or countercorrespondence to the reduction of the light-sensitive silver halide to silver at an elevated temperature, said base precursor containing a salt of a carboxylic acid and a diacidic, triacidic or tetraacidic organic base composed of a hydrocarbon group or a heterocyclic group substituted with 2 to 4 amidine groups represented by formula (I):

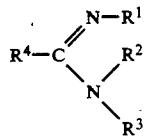

(I)

wherein $R^1$, $R^2$, $R^3$ and $R^4$, which may be the same or different, each represents a bond to the hydrocarbon group or heterocyclic group, hydrogen, a substituted or unsubstituted alkyl group, a substituted or unsubstituted alkenyl group, a substituted or unsubstituted alkynyl group, a substituted or unsubstituted cycloalkyl group, a substituted or unsubstituted aralkyl group, a substituted or unsubstituted aryl group or a substituted or unsubstituted heterocyclic group, provided that any two groups represented by $R^1$, $R^2$, $R^3$ and $R^4$ may be linked to form a 5-membered or 6-membered heterocyclic ring.

DETAILED DESCRIPTION OF THE INVENTION

In the base precursor in the present invention, the organic base which constitutes the base precursor contains two to four structures derived from an amidine represented by formula (I) described above.

The inventors have found that surprisingly a base precursor which remains extremely stable during normal preservation but suddenly releases a base once the temperature is elevated to a predetermined value can be obtained by using a diacidic, triacidic or tetraacidic base as described above as an organic base rather than by using an improved carboxylic acid. Without being bound in any way by theory, the reason for this improvement is assumed to be as follows.

In salts made of a carboxylic acid and an organic base, a salt made of an organic base which is a diacidic, triacidic or tetraacidic base has a more stable crystal structure than a salt made of an organic base which is a monoacidic base. In particular, if the diacidic, triacidic or tetraacidic base is symmetrical, the crystal structure of the salt is extremely stable.

In most cases, a decarboxylation accelerating group such as an aryl group is introduced into a carboxylic acid in the above-described base precursor. Therefore, the above-described carboxylic acid normally contains a hydrophobic residual group. In a base made of a carboxylic acid containing a hydrophobic residual group and an organic base which is a diacidic, triacidic or tetraacidic base, a plurality of hydrophobic residual groups are positioned via ion bonds around the organic base. Such a structure, in which an organic base is positioned in the center of the space surrounded by hydrophobic residual groups contained in a carboxylic acid, provides a more stable crystal structure than a structure in which an organic base and a hydrophobic residual contained in a carboxylic acid are positioned at opposite ends via an ionic bond.

In accordance with the present invention, a base precursor made of a carboxylic acid and an organic base is melted or dissolved in a binder or the like contained in the light-sensitive material upon heating, and the carboxylic acid then begins to undergo decarboxylation. Thus, the base precursor made of a salt having a stable crystal structure used in the present invention maintains its crystal structure until the temperature is elevated to a predetermined value, and then is melted or dissolved beyond this temperature, destroying its crystal structure, whereupon the decarboxylation reaction of the carboxylic acid suddenly takes place, causing release of the base.

If the carboxylic acid contains a hydrophobic residual group, the organic base and the carboxyl group contained in the carboxylic acid in the base precursor used in the present invention are blocked by the hydrophobic residual group. That is, the organic base and the carboxyl group are prevented from being dissolved in a binder (normally hydrophilic). At the same time, the both are stabilized by the intermolecular interaction of the hydrophobic residual group. Therefore, the base precursor used in the present invention, if it contains such a hydrophobic residual group, exhibits higher age stability.

Furthermore, the base precursor used in the present invention contains as an organic base a diacidic, triacidic or tetraacidic base derived from an amidine represented by formula (I). Accordingly, the present base precursor releases an amidine derivative having a strong basicity. This allows the pH of the reaction system to be sufficiently high during the heat development and/or the heat transfer. This enables the formation of a high S/N ratio image density.

Formula (I) will be further described hereinafter.

In formula (I), $R^1$, $R^2$, $R^3$ and $R^4$, which may be the same or different, each represents a group selected from the group consisting of hydrogen, an alkyl group, an alkenyl group, an alkynyl group, a cycloalkyl group, an aralkyl group, an aryl group, and a heterocyclic group. Preferred among these groups are hydrogen, an alkyl group, a cycloalkyl group, an aralkyl group, and an aryl group. Each of these groups may contain one or more substituents. Examples of substituents include hydroxyl group; substituted or unsubstituted alkyl, alkoxy, alkylthio, and amino groups; and a halogen atom. Such an alkyl group, alkenyl group or alkynyl group preferably contains 1 to 6 carbon atoms. Examples of the above described cycloalkyl group include a cyclohexyl group. Examples of the above described aralkyl group include a benzyl group. Examples of the above described aryl group include a phenyl group. Examples of the above described heterocyclic group include a pyridine group.

Any two groups selected from $R^1$, $R^2$, $R^3$ and $R^4$ may be connected to each other to form a five- or six-membered nitrogen-containing heterocyclic group. Particularly, $R^1$ and $R^2$ are preferably connected to each other to form a cyclic amidine represented by formula (I-2):

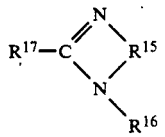

(I-2)

In formula (I-2), $R^{15}$ represents a divalent group selected from the group consisting of an ethylene group, a propylene group, a vinylene group, and a propenylene group. Each of these groups may contain one or more substituents. Examples of substituents include hydroxyl group; substituted or unsubstituted alkyl, alkoxy, alkylthio, and amino groups; and a halogen atom. Preferred among these groups are an ethylene group and a propylene group. Particularly preferred is a propylene group. That is, the cyclic amidine represented by formula (I-2) is preferably 2-imidazoline, 1,4,5,6-tetrahydropyrimidine or a derivative thereof. Such a cyclic amidine is particularly preferably 1,4,5,6-tetrahydropyrimidine or a derivative thereof.

$R^{16}$ has the same meaning as $R^3$ in formula (I). $R^{16}$ is particularly preferably hydrogen or an alkyl group.

$R^{17}$ has the same meaning as $R^4$ in formula (I). $R^{17}$ is particularly preferably hydrogen.

The above described cyclic amidine represented by formula (I-2) may be condensed with other heterocyclic groups (e.g., pyridine ring), alicyclic groups (e.g., cyclohexane) and/or aromatic rings (e.g., benzene ring).

The organic base which constitutes the base precursor in the present invention is a diacidic, triacidic or tetraacidic base containing two to four structures corresponding to an atomic group obtained by removing one or two hydrogen atoms from the amidine represented by formula (I), and one or more hydrocarbon groups or heterocyclic groups as groups connecting the amidine groups.

The above described amidine group may be a monovalent substituent linked by a hydrocarbon or heterocyclic connecting group, as shown in formula (II) below. That is, the above described amidine group is preferably an atomic group obtained by removing one hydrogen atom from the amidine represented by formula (I). Alternatively, the above described amidine group may be an atomic group obtained by removing two hydrogen atoms from the amidine represented by formula (I). In this case, the organic base which constitutes the base precursor of the present invention may form a condensed heterocyclic group (e.g., a tricyclic condensed ring).

The diacidic, triacidic or tetraacidic base represented by formula (II) is preferably used in the base precursor of the present invention:

$$R^5\text{-}(B)_n \qquad \text{(II)}$$

In formula (II), $R^5$ represents a hydrocarbon group or a heterocyclic group having a valency of n, and n is an integer of 2 to 4. In formula (II) n is preferably 2 or 3, and more preferably 2. When n is 2, preferred examples of the hydrocarbon group $R^5$ include an alkylene group, more preferably containing 1 to 6 carbon atoms, and an arylene group, more preferably a phenylene group. Examples of the heterocyclic group $R^5$ include those derived from a pyridine ring.

The diacidic, triacidic or tetraacidic base represented by formula (II) is preferably symmetrical. That is, in one molecule of the organic base, all B groups are the same.

B in formula (II) represents a monovalent group, i.e., an atomic group obtained by removing one hydrogen atom from the amidine represented by formula (I).

The position of the hydrogen atom to be removed is not specifically limited. However, if $R^4$ in formula (I) is a hydrogen atom, the hydrogen atom $R^4$ is particularly preferably removed. That is, the organic base represented by formula (II) is particularly preferably a diacidic, triacidic or tetraacidic base represented by formula (II-1):

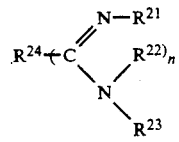

(II-1)

wherein $R^{21}$, $R^{22}$ and $R^{23}$ can be hydrogen or any of the groups defined for $R^1$, $R^2$ and $R^3$ in formula (I), respectively; $R^{24}$ has the same meaning as $R^5$ in formula (II); and n has the same meaning as in formula (II).

Any two groups selected from $R^{21}$, $R^{22}$ and $R^{23}$ may be connected to each other to form a five- or six-membered nitrogen-containing heterocyclic ring. $R^{21}$ and $R^{22}$ are particularly preferably connected to each other to form a diacidic, triacidic or tetraacidic base represented by formula (II-2):

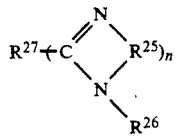

(II-2)

wherein $R^{25}$ and $R^{26}$ can be hydrogen or any of the groups defined for $R^{15}$ and $R^{16}$ in formula (I-2), respectively; $R^{27}$ has the same meaning as $R^5$ in formula (II); and n is as defined in formula (II).

Specific examples of preferred organic bases contained in the present base precursor are described hereinafter, but the present invention is not to be construed as being limited thereto.

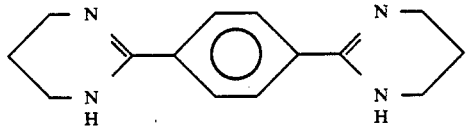

(B-1)

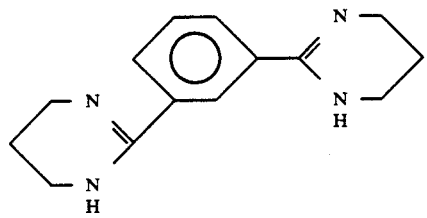

(B-2)

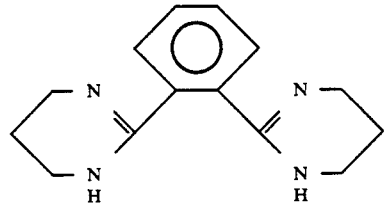

(B-3)

-continued
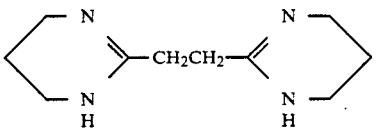
(B-4)
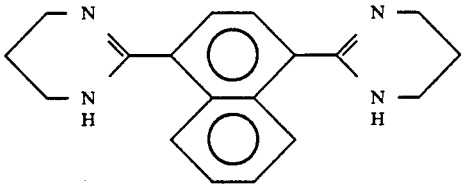
(B-5)
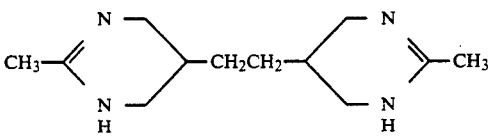
(B-6)
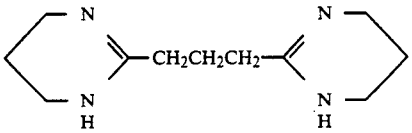
(B-7)
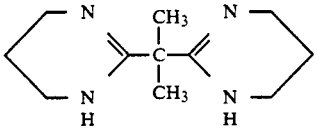
(B-8)
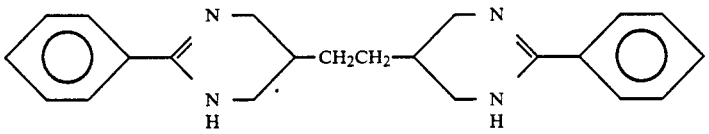
(B-9)
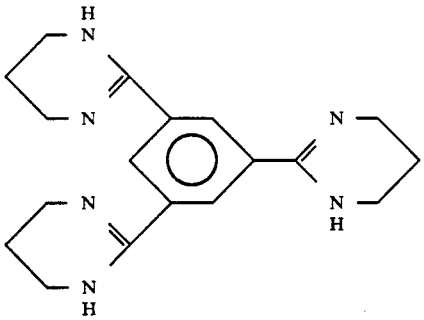
(B-10)
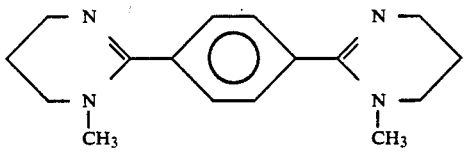
(B-11)
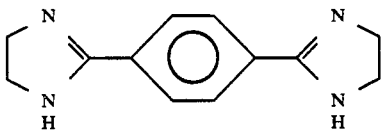
(B-12)

-continued
(B-13)
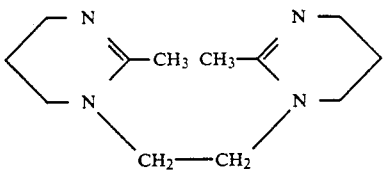
(B-14)
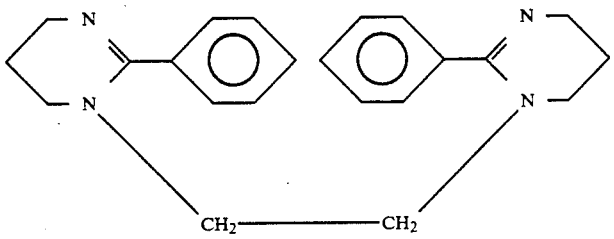
(B-15)
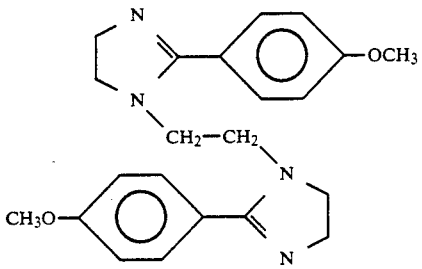
(B-16)
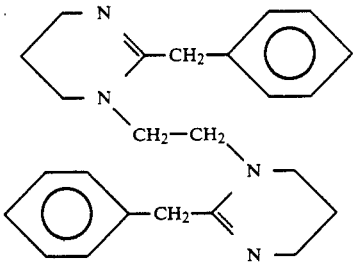
(B-17)
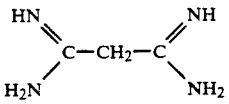
(B-18)
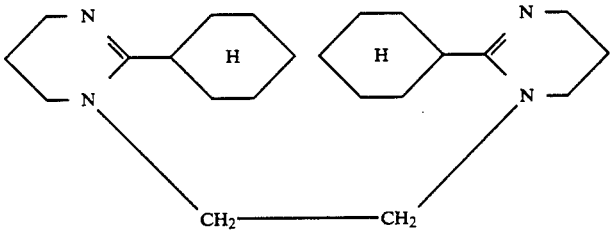
(B-19)
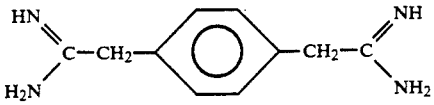

-continued
(B-20)
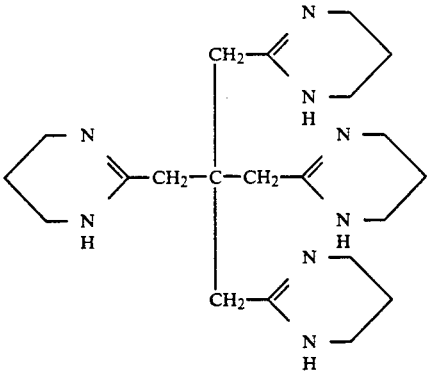
(B-21)
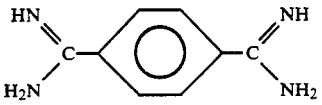
(B-22)
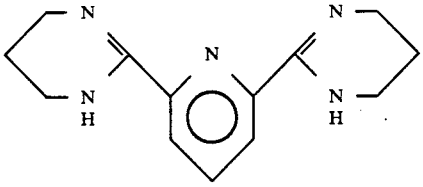
(B-23)
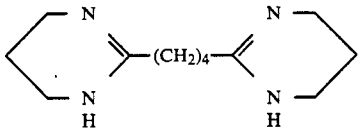
(B-24)
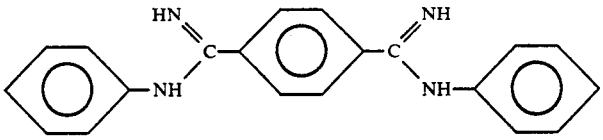
(B-25)
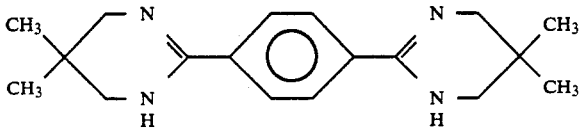
(B-26)
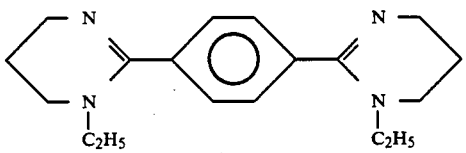
(B-27)
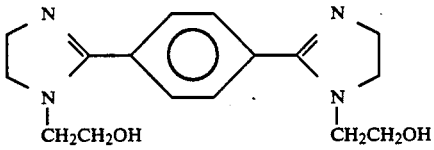
(B-28)
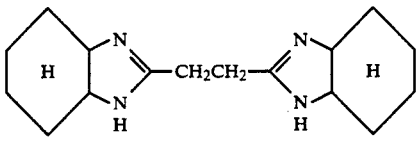

-continued (B-29)

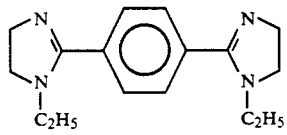

(B-30)

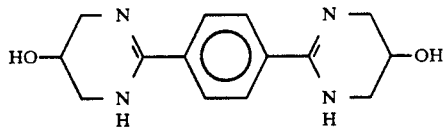

(B-31)

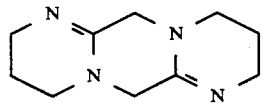

(B-32)

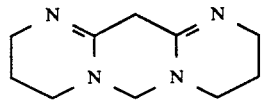

The heat developable light sensitive material of the present invention contains the above described base precursor. The carboxylic acid contained in the present base precursor must contain a carboxyl group which is stable during preservation but is decarboxylated on heating. However, since carboxyl groups generally have the above-described property, the base precursor used in the present invention may be any of various carboxylic acids.

The heating temperature required for decarboxylation of the above described carboxyl group is preferably in the range of 50° to 200° C., particularly 80° to 160° C.

Examples of carboxylic acids which satisfy the above requirements include trichloroacetic acid, propiolic acid, and sulfonylacetic acid, as described in the above cited Japanese patent publications. As described above, such a carboxylic acid preferably contains an aryl group or arylene group as a decarboxylation accelerating group. Particularly preferred examples of the above described carboxylic acid include sulfonylacetic acids represented by formula (III-1) and propiolic acids represented by formula (III-2).

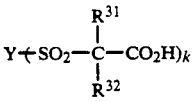

(III-1)

In formula (III-1) $R^{31}$ and $R^{32}$, which may be the same or different, each represents a monovalent group selected from the group consisting of hydrogen, an alkyl group, an alkenyl group, an alkynyl group, a cycloalkyl group, an aralkyl group, an aryl group, and a heterocyclic group. Preferred groups are hydrogen, an alkyl group, and an aryl group. Particularly preferred is hydrogen. Each of the alkyl group, alkenyl group or alkynyl group may contain one or more substituents, and preferably contains 1 to 8 carbon atoms. Examples of substituents include a halogen atom, an alkyl group, an alkoxy group, an acylamino group, a cyano group, and hydroxyl group.

In formula (III-1) k is an integer of 1 or 2. When k is 1, Y represents a monovalent group selected from the group consisting of an alkyl group, a cycloalkyl group, an alkenyl group, an alkynyl group, an aralkyl group, an aryl group, and a heterocyclic group. Preferred are an aryl group and a heterocyclic group, and particularly preferred is an aryl group. Each of these groups may have one or more substituents. Examples of substituents for the aryl group include a halogen atom, an alkyl group, an alkoxyl group, an alkylsulfonyl group, an arylsulfonyl group, an acylamino group, a carbamoyl group, and a sulfamoyl group.

When k is 2, Y represents a divalent group selected from the group consisting of an alkylene group, an arylene group, and a heterocyclic group. Preferred groups are an arylene group and a heterocyclic group, and particularly preferred is an arylene group. Each of these groups may contain one or more substituents. Examples of substituents for the arylene group include those described as substituents for the above-described aryl group.

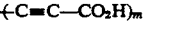

(III-2)

In formula (III 2) m is an integer of 1 or 2. When m is 1, Z represents a monovalent group selected from the group consisting of hydrogen, an alkyl group, a cycloalkyl group, an alkenyl group, an alkynyl group, an aralkyl group, an aryl group, a heterocyclic group, and a carboxyl group. Particularly preferred is an aryl group. Each of these groups may have one or more substituents.

When m is 2, Z represents a divalent group selected from the group consisting of an alkylene group, an arylene group, and a heterocyclic group. Particularly preferred is an arylene group. Each of these groups may contain one or more substituents.

Examples of substituents for Z include a halogen atom; substituted or unsubstituted alkyl, alkoxy, aryloxy, amino, alkylthio, alkylsulfonyl, arylsulfonyl, sulfamoyl, and carbamoyl groups; an acylamino group; an alkoxycarbonyl group; a sulfonylamino group; a cyano group; and a nitro group.

Specific examples of preferred carboxylic acids are shown below, but the present invention is not to be construed as being limited thereto.

(A-1)
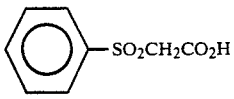
(A-2)
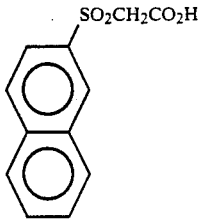
(A-3)
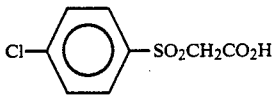
(A-4)
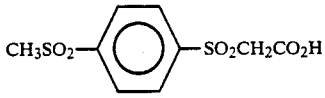
(A-5)
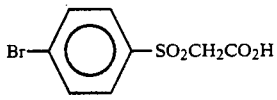
(A-6)
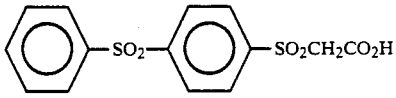
(A-7)
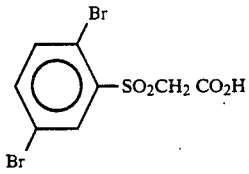
(A-8)
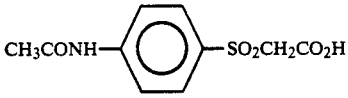
(A-9)
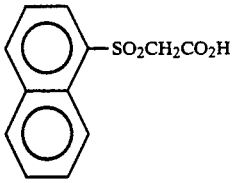
(A-10)
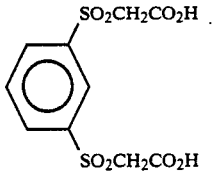
-continued
(A-11)
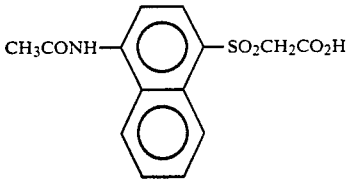
(A-12)
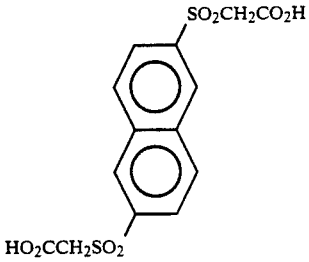
(A-13)
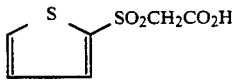
(A-14)
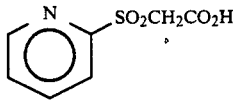
(A-15)
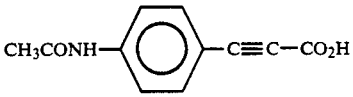
(A-16)
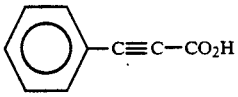
(A-17)
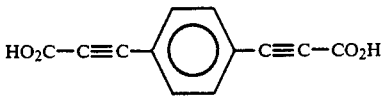
(A-18)
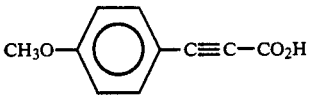
(A-19)
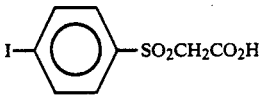
(A-20)
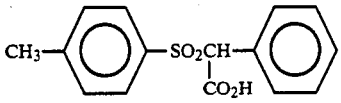
(A-21)
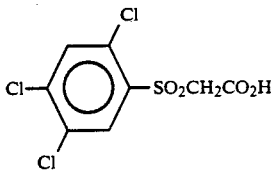

-continued (A-22)

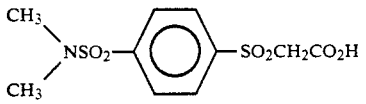

The base precursor used in the present invention is made of the above described carboxylic acid and organic base. The combination of the carboxylic acid and organic base is not specifically limited. However, the melting point of the salt of such a carboxylic acid and organic base is preferably in the range of 50° to 200° C., particularly 80° to 160° C.

Specific examples of suitable base precursors which can be used in the present invention are shown below, but the present invention is not to be construed as being limited thereto.

(1)

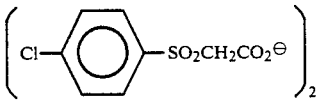

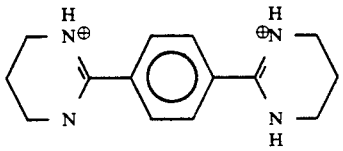

(2)

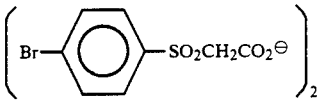

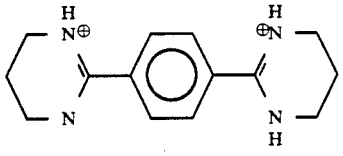

(3)

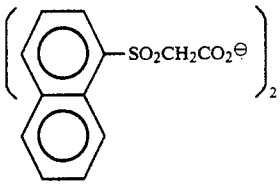

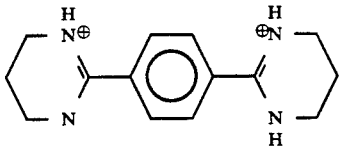

(4)

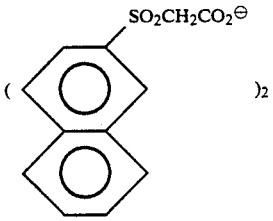

-continued
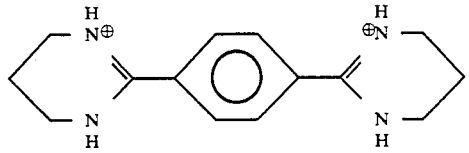
(5)
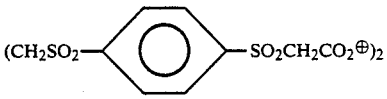
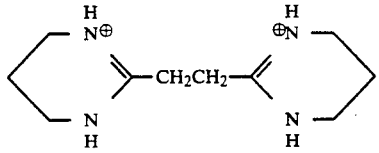
(6)
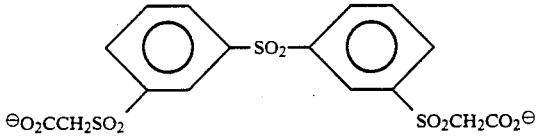
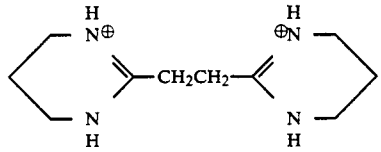
(7)
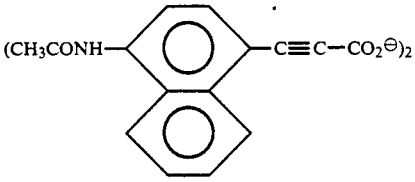
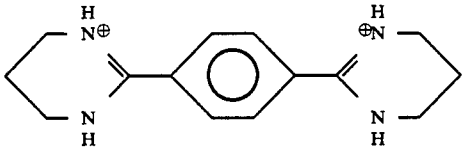
(8)
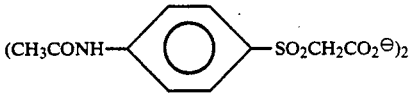
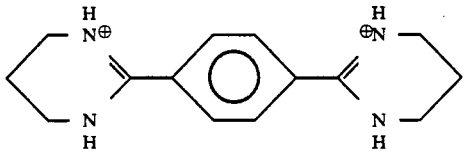

-continued
(9)
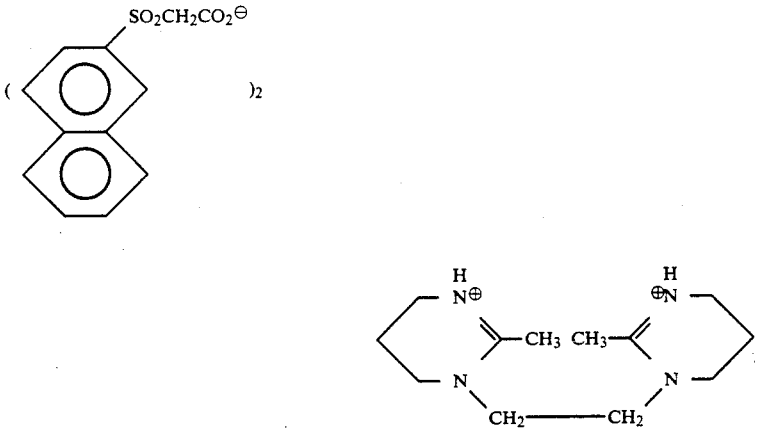
(10)
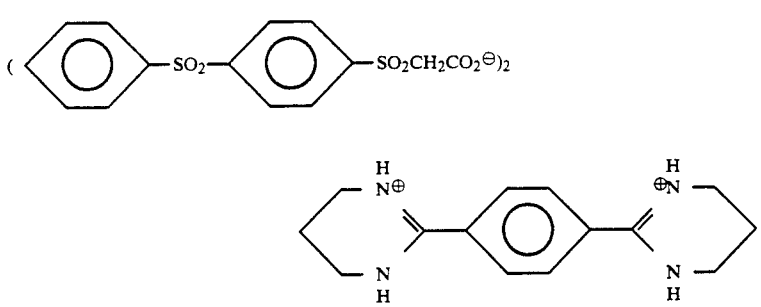
(11)
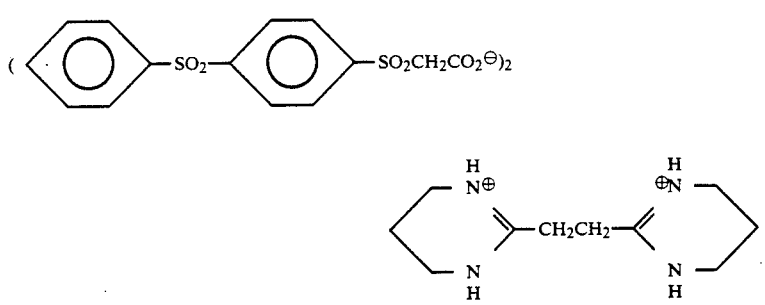
(12)
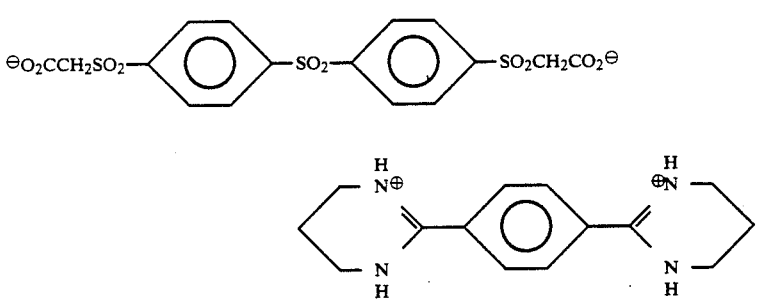
(13)
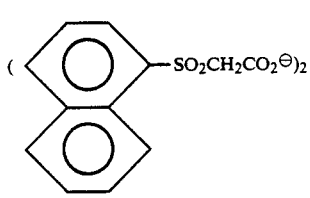

-continued
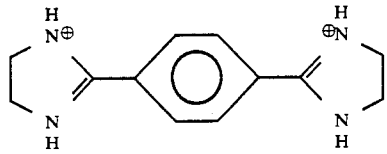
(14)
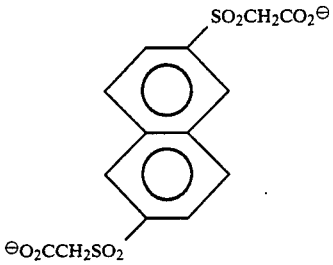
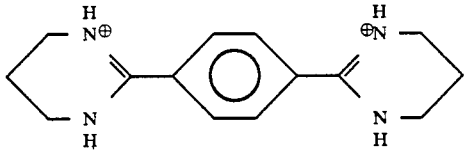
(15)
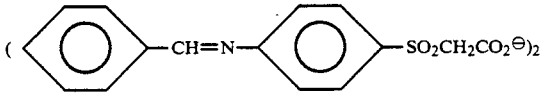
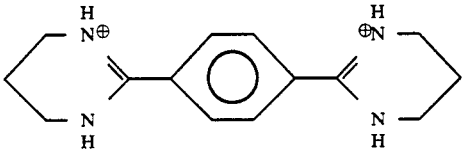
(16)
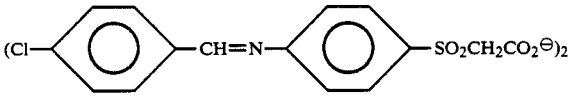
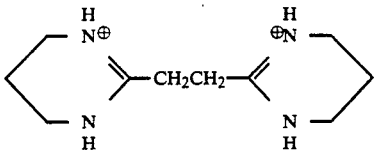
(17)
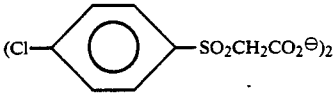
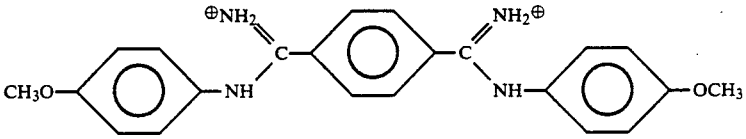

-continued
(18)
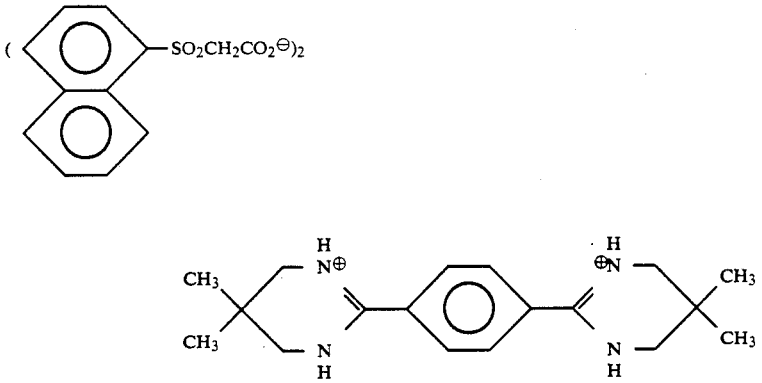
(19)
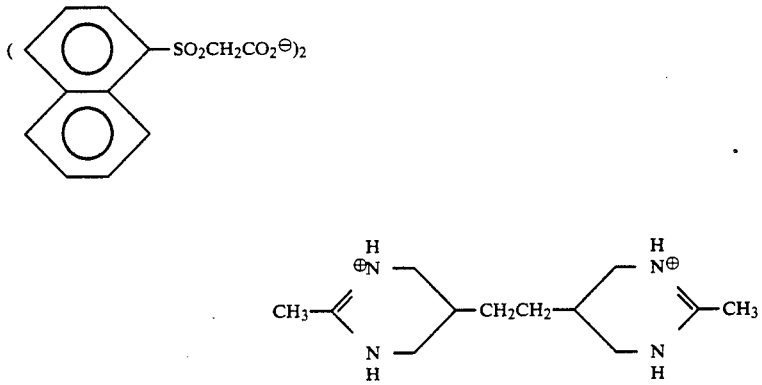
(20)
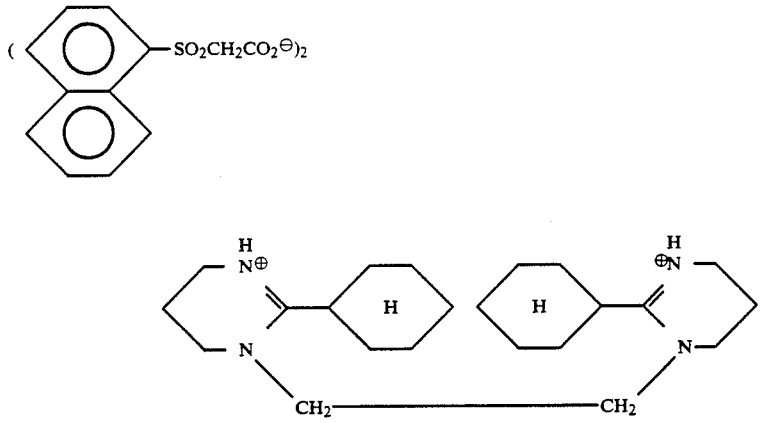
(21)
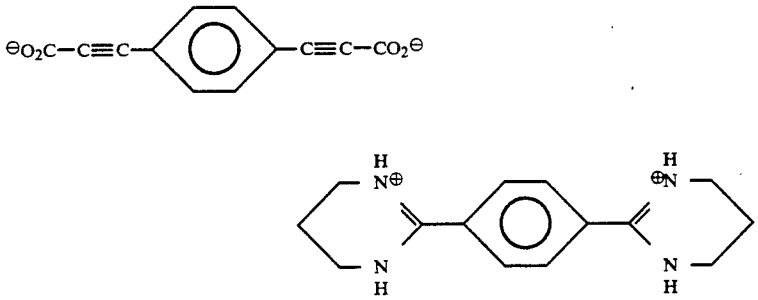

-continued
(22)
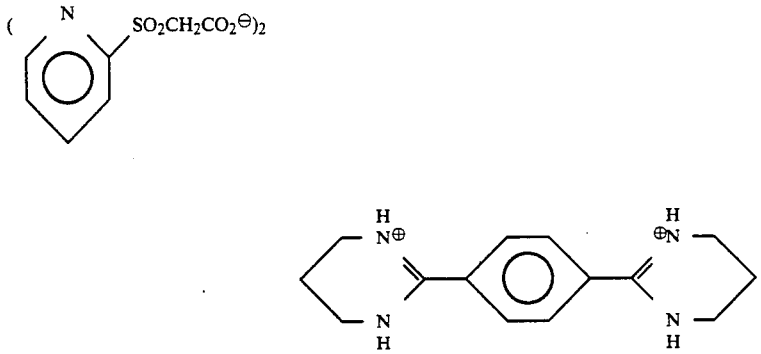
(23)
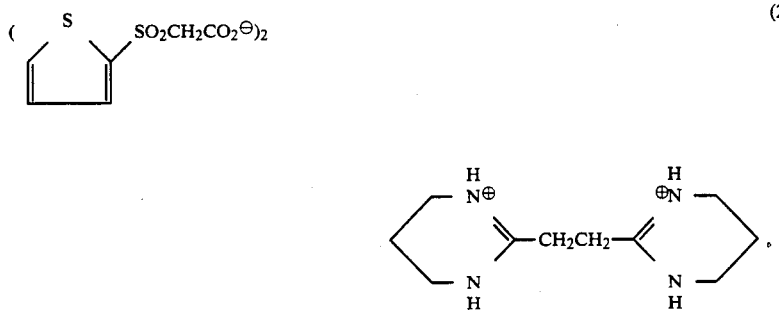
(24)
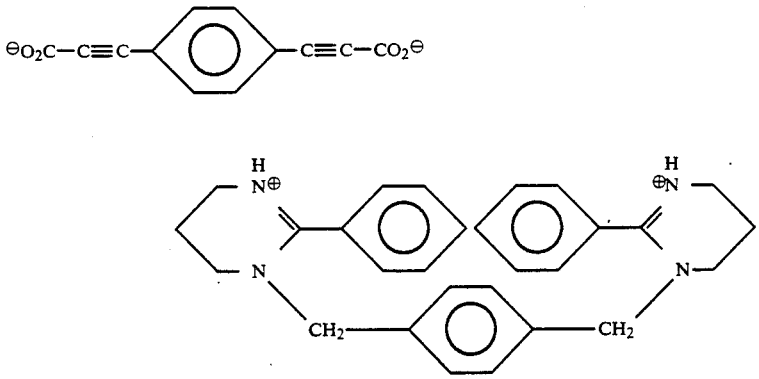
(25)
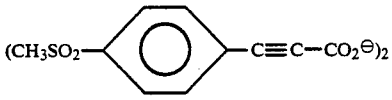
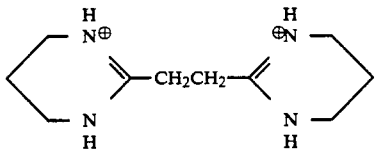
(26)
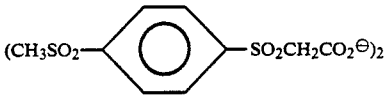

-continued

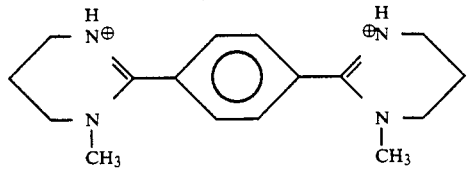

(27)

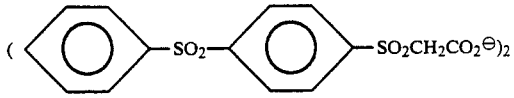

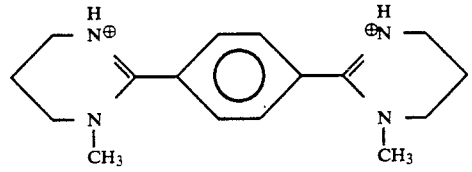

(28)

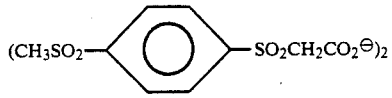

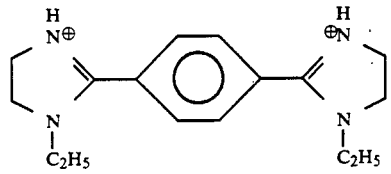

Examples of synthesis of base precursors (3) and (5) will be described below but one skilled in the art will easily be able to prepare other base precursors in a similar manner.

SYNTHESIS EXAMPLE 1

(i) Synthesis of 1-naphthalenesulfonyl chloride 133 g of sodium α-naphthalenesulfonate was suspended in a mixture of 260 ml of acetonitrile and 7 ml of dimethylacetamide. 80 ml of phosphorus oxychloride was added dropwise to the suspension while being cooled with water at a temperature of lower than 50° C. After the dropwise addition was completed, the reaction system was further reacted at a temperature of 65° C. for 1 hour. After cooled to 30° C., the reaction mixture was poured into 2 l of ice water. The resulting grayish white crystal was filtered off, and air-dried. The yield was 110.8 g (84.6% of theoretical value). The melting point of the product was 66° to 68° C.

(ii) Synthesis of 1-naphthalenesulfinic acid 110 g of 1-naphthalenesulfonyl chloride was added to 500 ml of an aqueous solution of 122 g of sodium sulfite. A 20% aqueous solution of 36 g of sodium hydroxide was added dropwise to the reaction mixture while being cooled with water to 30° C. until the pH value reached around 8. The reaction mixture became homogenous in about 1 hour. 135 ml of 35% hydrochloric acid was then added dropwise to the reaction mixture. The resulting grayish white crystal was then filtered off, and air dried. The yield was 91.4 g (98% of theoretical value).

(iii) Synthesis of 1-naphthylsulfonylacetic acid (A-9)

44 g of 1-naphthalenesulfinic acid, 17.4 g of potassium carbonate, and 34.4 g of isopropyl chloroacetate were suspended in 45 ml of isopropyl alcohol. The suspension was then heated under reflux for 3 hours, after which the reaction mixture was cooled to 30° C. A 20% aqueous solution of 13.8 g of sodium hydroxide was added to the reaction mixture. The reaction system was then stirred for 1 hour. The resulting solution was diluted with 58 ml of water. 58 ml of 35% hydrochloric acid was then added to the reaction mixture. The resulting crystal was then filtered off, and air-dried. The yield was 54.9 g (95.8% of theoretical value).

The crude crystal was then recrystallized from 165 ml of acetonitrile. The yield was 44 g. The melting point of the product was 168° to 172° C.

(iv) Synthesis of organic base (B-1)

A suspension of 384 g of terephthalonitrile, 533 g of 1,3-diaminopropane and 0.9 g of sulfur in 600 ml of toluene was heated under reflux for 12 hours. The reaction system was then cooled to a temperature of 70° C. 300 ml of methanol was added to the reaction system. The reaction system was further cooled to room temperature. The resulting crystal was then filtered off, and dried. The yield was 706.5 g (97.3% of theoretical value).

The crude crystal thus obtained was then recrystallized from 3 l of methanol. The yield was 567 g (78% of theoretical value). The melting point of the product was 313° C.

(v) Synthesis of base precursor (3)

A solution of 41.2 g of 1-naphthylsulfonylacetic acid (A-9) and 120 ml of methanol was added to a suspension of 19.3 g of the organic base (B-1) thus prepared in 160 ml of methanol. The resulting homogeneous solution produced a crystal which was then filtered off, and air-dried. The yield was 55.0 g (92.7% of theoretical value).

SYNTHESIS EXAMPLE 2

(i) Synthesis of organic base (B-4)

A solution of 40 g of succinonitrile, 100 ml of 1,3-diaminopropane, 0.3 g of sulfur, and 60 ml of toluene was heated under reflux for 3 hours. After the reaction mixture was cooled to room temperature, the resulting crystal was then filtered off, washed with acetonitrile, and dried. The yield was 95 g (98% of theoretical value). The melting point of the product was 218° C.

(ii) Synthesis of base precursor (5)

A solution of 11.6 g of the organic base (B-4) thus prepared in 20 ml of methanol was added to a suspension of 36 g of p-methylsulfonylphenylsulfonylacetic acid (A-4) in 150 ml of metanol. The reaction mixture was then stirred for 1 hour. The resulting crystal was then filtered off. The yield was 44.6 g (99% of theoretical value).

The incorporation of the above described base precursor enables the heat developable light-sensitive material of the present invention easily to be developed upon heating after being exposed to light. The base precursor is preferably isolated from the other components in the light-sensitive material by emulsion dispersion, solid dispersion, micro-encapsulation, or the like. Particularly, the easiest isolation process is to disperse finely divided solid particles of the base precursor in the light-sensitive material. The base precursor of the present invention is advantageous in that it can be effectively isolated from the other components in the light-sensitive material.

The layer in which the above described base precursor is incorporated is not specifically limited. Examples of such a layer include a silver halide emulsion layer, an interlayer, a protective layer and other hydrophilic colloid layer in the heat developable light-sensitive material.

The above-described base precursos may be used singly or in ccmbination. The base precursor of the present invention is preferably used in an amount of 50% by weight or less, particularly 0.01 to 40% by weight, based on the total dry weight of all coated layers of the light-sensitive material.

There are many methods for producing a base other than using the above described base precursor of the present invention. All compounds to be used in these methods are useful as base precursors and can be used in combination with the base precursor according to the present invention. Examples of these methods include a method described in European Patent 210,660A of mixing a sparingly-soluble metal compound with a compound capable of complexing metal ions which constitute the sparingly-soluble metal compound (complexing compound) to produce a base, and a method described in JP-A-61-232451 of electrolysis to produce a base. These methods can be used in combination with the above described base precursor in the present invention.

In the former method, the sparingly-soluble metal compound includes a carbonate, hydroxide or oxide of zinc, aluminum, calcium or barium. The complexing compound used in this method is described in detail in A.E. Martell and R.M. Smith, *Critical Stability Constants*, Vols. 4 and 5, (Plenum Press). Specific examples of such a complexing compound include salts of aminocarboxylic acids, iminodiacetic acids, pyridylcarboxylic acids, aminophosphoric acids, carboxylic acids (e.g. monocarboxylic acid, dicarboxylic acid, tricarboxylic acid, tetracarboxylic acid, and compounds containing substituents such as a phosphono group, hydroxyl group, oxo group, ester group, amido group, alkoxy group, mercapto group, alkylthio group, and phosphino group), hydroxamic acids, polyacrylates, and polyphosphoric acids with alkali metals, guanidines, and quaternary ammonium salts.

The sparingly-soluble metal compound and the complexing compound are advantageously incorporated separately in a light-sensitive element and a dye fixing element, respectively.

The heat developable light-sensitive material of the present invention is particularly preferably used in an image formation process which includes heating the light-sensitive material after or simultaneously with the imagewise exposure thereof, and then diffusing a diffusible dye thus produced or released to a dye fixing layer upon or after heating for development.

The silver halide used in the present invention may be any of silver chloride, silver bromide, silver chlorobromide, silver chloroiodide, and silver chloroiodobromide.

Particularly, any of the silver halide emulsions described in U.S. Pat. No. 4,500,626 (50th column), *Research Disclosure*, No. 17,029 (June 1978, pp. 9 to 10), JP-A-61-107240, JP-A-62-85241, and JP-A-62-87957 may be used in the present invention.

The silver halide emulsion grains to be used in the present invention may be of surface latent image type, in which latent images are formed mainly in the surface portion thereof, or of internal latent image type, in which latent images are formed mainly in the interior thereof. Alternatively, the silver halide emulsion grains used in the present invention may be core/shell grains in which the interior and the surface layer differ in phase. Furthermore, a direct reversal emulsion containing a combination of an internal latent image type emulsion and a nucleating agent can be used in the present invention.

The present silver halide emulsion may be used unripened. However, the present silver halide emulsion is normally subjected to chemical sensitization before use, using a known sulfur sensitization process, reduction sensitization process, noble metal sensitization process, or the like, alone or in combination. These chemical sensitization processes can be effected in the presence of a nitrogen-containing heterocyclic compound as described in JP-A-58-126526 and JP-A-58-15644.

The coated amount of the light-sensitive silver halide used in the present invention is in the range of 1 mg to 10 g/m$^2$ calculated in terms of silver.

In the present invention, an organic metal salt may be used as an oxidizing agent in combination with the light-sensitive silver halide. In this case, it is necessary that the light-sensitive silver halide and the organic metal salt be kept in close contact with each other or at a close distance from each other.

Particularly preferred among these organic metal salts is an organic silver salt.

Examples of organic compounds which can be used to form the above described organic silver salt oxidizing agent include those described in JP-A-61-107240 and U.S. Pat. No. 4,500,626 (52nd column to 53rd column). Furthermore, silver salts of carboxylic acids containing an alkyl group such as silver phenylpropiolate as described in JP-A-60-113235 and acetylene silver as described in JP-A-61-249044 are useful. These organic silver salts may be used alone or in combination.

Such an organic silver salts may be used in an amount of 0.01 to 10 mol, preferably 0.01 to 1 mol, per mol of light-sensitive silver halide. The total coated amount of the light-sensitive silver halide and the organic silver salt is preferably in the range of 50 mg to 10 g/m$^2$ calculated in terms of silver.

The silver halide used in the present invention may be spectrally sensitized with a methine dye or the like. Examples of such a dye include cyanine dye, merocyanine dye, composite cyanine dye, composite merocyanine dye, holopolar cyanine dye, hemicyanine dye, styryl dye and hemioxonol dye.

Specific examples of these dyes include sensitizing dyes as described in JP A-59 180550, JP A-60-140335, and *Research Disclosure*, No. 17,029 (June 1978, pp. 12 to 13), and heat-decolorable sensitizing dyes as described in JP-A-60-111239 and JP-A-62-32445.

These sensitizing dyes can be used singly or in combination. Such a combination of these sensitizing dyes is often used for the purpose of supersensitization.

Besides such a sensitizing dye, the above described emulsion may contain a dye which has no spectral sensitizing effect itself or a substance which does not substantially absorb visible light but exhibits supersensitization (e.g., those described in U.S. Pat. Nos. 2,933,390, 3,635,721, 3,743,510, 3,615,613, 3,615,641, 3,617,295, and 3,635,721).

The incorporation of such a sensitizing dye in the emulsion may be effected during or before or after the chemical ripening. Alternatively, it may be effected before or after the formation of nuclei of silver halide grains in accordance with U.S. Pat. Nos. 4,183,756 and 4,225,666.

The amount of the sensitizing dye to be incorporated is normally in the range of $10^{-8}$ to $10^{-2}$ mol per mol of silver halide.

The present heat developable light-sensitive material contains as an image forming substance a compound which produces or releases a mobile dye in correspondence or countercorrespondence to the reduction of silver ions to silver at an elevated temperature, referred to herein as a dye-providing compound or substance.

An example of such a dye-providing compound which can be used in the present invention is a compound which undergoes an oxidation coupling reaction to form a dye (i.e., coupler). Such a coupler may be a two-equivalent or four-equivalent coupler. Alternatively, a two-equivalent coupler containing a nondiffusible group in the split-off group which undergoes an oxidation coupling reaction to form a diffusible dye may be preferably used in the present invention. Specific examples of developing agents and couplers which can be used in the present invention are described in detail in T.H. James, *The Theory of the Photographic Process*, 4th Ed., pp. 291 to 334 and pp. 354 to 361 (1977), JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Another example of such a dye-providing compound is a compound which serves to release or diffuse a diffusible dye imagewise. This type of a compound can be represented by formula [LI]:

$$(\text{Dye-X})_n\text{—Y} \qquad [\text{LI}]$$

wherein Dye represents a dye group, or a dye group or dye precursor group which has been temporarily shifted to a short wavelength side; X represents a simple bond or a divalent linking group; Y represents a group capable of altering the diffusibility of the compound represented by $(\text{Dye-X})_n$—Y in correspondence or countercorrespondence to light sensitive silver salts having a latent image distributed imagewise, or capable of releasing Dye in correspondence to or countercorrespondence the light-sensitive silver salts, the diffusibility of Dye being different from that of the compound represented by $(\text{Dye-X})_n$—Y; and n represents an integer of 1 or 2. When n represents 2, the two (Dye-X)'s may be the same or different.

Specific examples of the dye-providing substance represented by formula [LI] include dye developing agents containing a hydroquinone developing agent connected to a dye component as described in U.S. Pat. Nos. 3,134,764, 3,362,819, 3,597,200, 3,544,545, and 3,482,972. A substance which undergoes an intramolecular nucleophilic displacement reaction to allow a diffusible dye to be released is described in U.S. Pat. No. 3,980,479. A substance which undergoes an intramolecular rewinding reaction of an isoxazolone ring to release a diffusible dye is described in JP-A-49-111628.

Another process has been proposed of converting a dye-releasing compound into an oxidized compound incapable of releasing a dye, allowing the compound to be present with a reducing agent or its precursor, and reducing the compound with the reducing agent which has been left unoxidized after development to allow a diffusible dye to be released. Specific examples of a dye-providing substance which can be used in this process are described in JP-A-53-110827, JP-A-54-130927, JP-A-56-164342, and JP-A-53-35533. As a dye-providing substance which releases a diffusible dye by a similar mechanism, a compound which undergoes N-O cleavage by the remaining reducing agent to release a diffusible dye is described in European Patent 220,746A and Kokai Giho, 87-6,199 (Vol. 12 to 22).

Alternatively, a nondiffusible compound (LDA compound) as described in JP-A-185333 which undergoes a donor acceptor reaction in the presence of a base to release a diffusible dye but undergoes a reaction with an oxidation product of a reducing agent to release substantially no dye can be used in the present invention.

In any of these processes, a diffusible dye is released or diffused in undeveloped portions. No dye is released or diffused in developed portions.

On the other hand, as a substance which releases a diffusible dye in developed portions, a coupler containing a diffusible dye in the split-off group which undergoes a reaction with an oxidation product of a reducing agent to release the diffusible dye (DDR coupler) is described in British Patent 1,330,524, JP-B-48 39165 (the term "JP-B" as used herein means an "examined Japanese patent publication"), and U.S. Pat. No. 3,443,940. Such a DDR coupler is preferably used in the present invention.

The process using a reducing agent may cause a severe problem of stain in images from the product of oxidation decomposition of the reducing agent. In order to prevent this, a substance which needs no reducing agent and has a reducing power itself (DRR compound) has been proposed. Such a compound may be particularly advantageously used in the present invention. Typical examples of such a DRR compound include dye-providing substances described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51 104343, JP-A-58-116537, and JP-A-57-179840, and *Research Disclosure*, No. 17,465. Specific examples of such a dye-providing substance include compounds described in U.S. Pat. No. 4,500,626 (22nd column to 44th column). Particularly preferred among these compounds are Compounds (1) to (3), (10) to (13), (16) to (19), (28) to (30), (33) to (35), (38) to (40), and (42) to (64). Furthermore, the compounds described in JP-A-61-124941 (pp. 80 to 87) are useful.

As dye-providing substances other than those described above there can be used a dye-silver compound containing a dye connected to an organic silver salt as described in *Research Disclosure* (May 1978, pp. 54 to 58); azo dyes for use in a heat developable silver dye bleaching process as described in U.S. Pat. No. 4,235,957, and *Research Disclosure* (April 1976, pp. 30 to 32); and leuco dyes as described in U.S. Pat. Nos. 3,985,565 and 4,022,617.

In the present invention, the light-sensitive element preferably contains a reducing substance. Examples of such a reducing substance include substances commonly known as reducing agents and the above described dye-providing substances having a reducing power. Another example of such a reducing substance is a reducing agent precursor which has no reducing power itself but exhibits a reducing effect by the action of a nucleophilic reagent or heat during the development process.

Examples of reducing agents which can be used in the present invention include reducing agents described in U.S. Pat. Nos. 4,500,626 (49th column to 50th column) and 4,483,914 (30th column to 31st column), JP-A-60-140335, JP-A-60-128438, JP-A-60-128436, JP-A-60-128439, and JP-A-60-128437. Other examples of reducing agents which can be used in the present invention include reducing agent precursors described in JP-A-56-138736 and JP-A-57-40245, and U.S. Pat. No. 4,330,617.

A combination of various reducing agents disclosed in U.S. Pat. No. 3,039,869 may be used in the present invention.

In the present invention, the amount of the reducing agent to be incorporated is preferably in the range of 0.01 to 20 mol, particularly 0.1 to 10 mol, per mol of silver.

The incorporation of the base precursor of the present invention, the above described dye-providing compound or reducing substance, and hydrophobic additives such as image formation accelerators described hereinafter in the light sensitive element layer can be accomplished by any suitable known methods, such as that described in U.S. Pat. No. 2,322,027. In this case, a high boiling organic solvent as described in JP-A-59-83154, JP-A-59-178451, JP-A-59-178452, JP-A-59-178453, JP-A-59-178454, JP-A-59-178455, and JP-A-59-178457 may be used in combination with a low boiling organic solvent having a boiling point of 50° to 160° C. as necessary.

The amount of such a high boiling organic solvent to be used is 10 g or less, preferably 5 g or less, per gram of the dye-providing substance used.

Alternatively, a dispersion process using a polymer material as described in JP-B-51-39853 and JP-A-51-59943 may be used in the present invention.

If the compound to be incorporated is substantially insoluble in water, it may be finely dispersed in a binder.

If a hydrophobic substance is dispersed in a hydrophilic colloid, various surface active agents can be used. As such surface active agents there can be used those described in JP-A-59-157636.

In the present invention, a compound which serves both to activate development and stabilize images may be incorporated in the light-sensitive element. Specific examples of such a compound which can be preferably used in the present invention are described in U.S. Pat. No. 4,500,626 (51st column to 52nd column).

In the present invention, various fog inhibitors or photographic stabilizers may be used. Examples of such a fog inhibitor or photographic stabilizer which can be used in the present invention include azoles and azaindenes as described in *Research Disclosure* (Dec. 1978, pp, 24 to 25), nitrogen-containing carboxylic acids and phosphoric acids as described in JP-A-59-168442, mercapto compounds and their metal salts as described in JP-A-59-111636, and acetylene compounds as described in JP-A-62-87957.

In the present invention, an image toner may be incorporated in the light-sensitive element as necessary. Specific examples of effective image toners include compounds as described in JP-A-61-147244.

In order to obtain a wide range of colors from the subtractive primaries, i.e., yellow, magenta and cyan, a light-sensitive element containing a silver halide emulsion layer having at least three layers having sensitivities in different spectral regions may be used. Examples of such a combination of sensitive layers include a combination of a blue-sensitive layer, a green sensitive layer and a red-sensitive layer and a combination of a green-sensitive layer, a red-sensitive layer and an infrared-sensitive layer. Each of these light-sensitive layers may optionally consist of two or more layers.

The light sensitive element used in the present invention may optionally contain various additives known as additives for heat developable light-sensitive element, and layers other than a light-sensitive layer, e.g., a protective layer, interlayer, antistatic layer, antihalation layer, release layer for facilitating peeling from the dye-fixing element, and matting layer. Examples of various additives include plasticizers, matting agents, sharpness improving dyes, antihalation dyes, surface active agents, fluorescent brightening agents, anti-slip agents, antioxidants and discoloration inhibitors as described in *Research Disclosure* (June 1978, pp. 9 to 15) and JP-A-61 88256.

Particularly, the protective layer normally contains an organic or inorganic matting agent for the purpose of inhibiting adhesion. The protective layer may also contain a mordant, an ultraviolet absorber or the like. The protective layer and the interlayer each may consist of two or more layers.

The interlayer may contain a reducing agent for inhibiting discoloration or color stain, an ultraviolet absorber or a white pigment such as titanium dioxide. Such a white pigment may be incorporated not only in the interlayer but also in the emulsion layer for the purpose of improving sensitivity.

The photographic element of the present invention consists of a light-sensitive element which undergoes heat development to produce or release a dye, and optionally a dye fixing element which serves to fix a dye.

Particularly, in a system of diffusion transfer of dye to form images, a light-sensitive element and a dye fixing element are indispensable. Such materials can be roughly divided into two systems: one in which a light sensitive element and a dye fixing element are separately coated on two supports, and the other in which a light-sensitive element and a dye fixing element are coated on the same support. For the relationship between the light-sensitive element and the dye fixing element, between the light-sensitive element and the support, and between the light-sensitive element and the white reflective layer, those described in JP-A-61-147244 and U.S. Pat. No. 4,500,626 (57th column) can be applied to the present invention.

The dye fixing element which is preferably used in the present invention has at least one layer containing a mordant and a binder. Any mordant can be used that is known in the field of photography. Specific examples of such a mordant include those described in JP-A-61-88256. The dye fixing element may be optionally provided with a protective layer, a release layer, an anticurl layer, or other auxiliary layers. Particularly, the provision of a protective layer is advantageous. One or a plurality of the above described layers may contain a hydrophilic heat solvent, a plasticizer, a discoloration inhibitor, an ultraviolet absorber, a lubricant, a matting agent, an antioxidant, a dispersed vinyl compound for increasing the dimensional stability, a surface active agent, a fluorescent brightening agent, or the like.

In the present invention, the light-sensitive element and/or the dye fixing element may contain an image formation accelerator. Such an image formation accelerator serves to accelerate the redox reaction of a silver salt oxidizing agent and a reducing agent, the production or decomposition of a dye from a dye-providing substance or release of a diffusible dye form a dye-providing substance, and the transfer of a dye from a light-sensitive material layer to a dye fixing layer. From the physicochemical standpoint, such an image formation accelerator can be classified as a base or base precursor, nucleophilic compound, high boiling organic solvent (oil), heat solvent, surface active agent, compound capable of mutual interaction with silver or silver ion, and the like. These groups normally exhibit a composite function and some of the above described accelerating effects. The details of such an image formation accelerator and its effects are described in JP-A-61-93451.

The present light-sensitive element and/or dye fixing element may contain various development stopping agents for the purpose of providing desired images despite fluctuations in the developing temperature and developing time.

The term "development stopping agent" as used herein means a compound which, after suitable development, readily neutralizes or reacts with a base to decrease the base concentration in the film so that development is stopped, or a compound which, after suitable development, interacts with silver or a silver salt to inhibit development. Specific examples of such a development stopping agent include acid precursors which release an acid upon heating, electrophilic compounds which undergo a displacement reaction with a base present therewith upon heating, nitrogen-containing heterocyclic compounds, and mercapto compounds and their precursors (e.g., the compounds described in JP-A-60-108837, JP-A-60-192939, JP-A-60-230133, and JP-A-60-230134).

Alternatively, a compound which releases a mercapto compound may be preferably used in the present invention. Examples of such a compound include those described in JP-A-61-67851, JP-A-61-147244, JP-A-61-124941, JP-A-61-185743, JP-A-61-182039, JP-A-61-185744, JP-A-61-184539, JP-A-61-188540, and JP-A-61-53632.

As a suitable binder for the present light-sensitive element and/or dye fixing element a hydrophilic binder may be used. Typical examples of such a hydrophilic binder include transparent or semi-transparent hydrophilic binders. Examples of such binders include natural substances such as proteins (e.g., gelatin and gelatin derivatives), and polysaccharides (e.g., cellulose derivatives, starch, and gum arabic), and synthetic polymer materials such as water-soluble polyvinyl compounds (e.g., polyvinylpyrrolidone and acrylamide polymers). Alternatively, a dispersed vinyl compound which serves to improve the dimensional stability of the photographic material may be used in the form of a latex. These binders may be used singly or in combination.

In the present invention, the coated amount of the binder is 20 g or less, preferably 10 g or less, particularly preferably 7 g or less, per $m^2$.

The proportion of the high boiling organic solvent to be dispersed with a hydrophobic compound such as a dye-providing substance in the binder to the binder is 1 cc or less, preferably 0.5 cc or less, particularly 0.3 cc or less, per gram.

The present light-sensitive element and/or dye fixing element may contain an organic or inorganic film hardener in layers such as a photographic emulsion layer and a dye fixing layer.

Specific examples of such a film hardener include those described in JP-A-61-147244 and JP-A-59-157636. These film hardeners may be used singly or in combination.

Any conventional support can be used for the present light-sensitive element and/or dye fixing element that can withstand the processing temperature. As a general support there may be glass, cast coated paper, synthetic paper, polymer films, metals, or similar materials. Besides the above materials, materials described as supports in JP-A-61-147244 may be used in the present invention.

The present light-sensitive element and/or dye fixing element may contain an electroconductive heating element layer as a heating means for heat development or diffusion transfer of dye. In this case, a transparent or opaque heating element can be prepared as a resistive heating element by any suitable known technique. As such a resistive heating element there may be used a thin film of a semi-conductive inorganic material or a thin film containing finely divided particles of an organic material dispersed in a binder. Materials which can be used for such a heating element include those described in JP A-61-29835.

In the present invention, the coating of a heat developable light-sensitive layer, protective layer, interlayer, subbing layer, back layer, dye fixing layer, or the like can be accomplished by any suitable method, such as those described in U.S. Pat. No. 4,500,626 (55th column to 56th column).

The light by which images are recorded on the light-sensitive material includes radiations, including visible light. In general, light sources used in ordinary color printing can be used. Examples of such light sources include a tungsten lamp, mercury vapor lamp, halogen lamp such as an iodine lamp, xenon lamp, laser lamp, CRT, light emitting diode (LED), and the light sources described in JP-A-61-147244 and U.S. Pat. No. 4,500,626 (56th column).

The heating temperature at which the heat developable light-sensitive material can be heat-developed is from about 50° C. to about 250° C., particularly from about 80° C. to about 160° C. The diffusion transfer of a dye may be effected at the same time as or after the heat development. In the latter case, the heating temperature at which a dye can be transferred at the transfer process is from room temperature to the temperature used for the heat development process, particularly from 50° C. to a temperature about 10° C. less than the temperature used for the heat development process.

The transfer of a dye can be effected only by heat. However, a proper solvent can be used to accelerate the transfer of a dye.

Alternatively, as described in detail in JP-A-59-218443 and JP A-61-238056, development and dye transfer may be effected simultaneously or sequentially by heating in the presence of a small amount of a solvent, particularly water. In this process, the heating temperature is preferably from 50° C. to the boiling point of the solvent. In the case of water, for example, the heating temperature is preferably from 50° C. to 100° C.

Examples of a suitable solvent for use in the acceleration of development and/or the transfer of a diffusible dye to the dye fixing layer include water and a basic aqueous solution of an inorganic alkali metal salt or organic base. As such a base there may be used a base described with reference to the image formation accelerators. Alternatively, a low boiling solvent or a mixture of a low boiling solvent with water or a basic aqueous solution may be used. A surface active agent, a fog inhibitor, a complexing compound with a sparingly-soluble metal salt, or the like may be contained in the solvent.

These solvents may be provided to either or both of the dye fixing element and the light-sensitive element. The amount of these solvents used may be less than the weight thereof corresponding to the maximum swelling volume of the total coated film (particularly less than the value obtained by subtracting the weight of the total coated film from the weight of the solvent corresponding to the maximum swelling volume of the total coated film).

The solvent (e.g., water) may be provided between the light-sensitive layer in the light-sensitive element and the dye fixing layer in the dye fixing element to accelerate the formation of images and/or the transfer of a dye. Alternatively, the solvent may be previously incorporated in either or both of the light-sensitive element and the dye fixing element.

The provision of the solvent in the light-sensitive layer or the dye fixing layer can be accomplished by a method as described in JP-A-61-147244.

In order to accelerate the transfer of a dye, a hydrophilic heat solvent which is solid at normal temperature but is soluble at an elevated temperature may be incorporated in the light-sensitive element or the dye fixing element. In this process, such a hydrophilic heat solvent may be incorporated in either or both of the light-sensitive element and the dye fixing element. Such a hydrophilic heat solvent may be incorporated in any of the emulsion layer, the interlayer, the protective layer and the dye fixing layer. Particularly, the solvent may be preferably incorporated in the dye fixing layer and/or an adjacent layer thereto.

Examples of such a hydrophilic heat solvent include ureas, pyridines, amides, sulfonamides, imides, alcohols, oximes, and other heterocycles.

Alternatively, in order to accelerate the transfer of a dye, a high boiling organic solvent may be incorporated in the light sensitive element and/or the dye fixing element.

As a heating means for use in the development process and/or the transfer process there may be used a means such as heating plate, iron, and heating roller as described in JP-A-61-147244. Alternatively, a layer of an electroconductive material such as graphite, carbon black and metals may be provided superposed on the light-sensitive element and/or the dye fixing element. When an electric current flows through the electroconductive layer, such a system can produce heat itself.

The pressure condition and pressure application method by which the light-sensitive element and the dye fixing element are bonded to each other are described in JP-A-61-147244.

The processing of the photographic element of the present invention may be accomplished using various heat developing apparatus. Examples of heat developing apparatus which can be preferably used in the present invention include those described in JP-A-59-75247, JP-A-59-177547, JP-A-59-181353, and JP-A-60-18951, and JP-A-U-62-25942. (The term "JP-A-U" as used herein means an "unexamined published Japanese utility model application".)

The present invention will be described in greater detail in the following examples, but the present invention is not to be construed as being limited thereto. Unless otherwise indicated, all parts, percents and ratios are by weight.

EXAMPLE 1

A benzotriazole silver emulsion containing light-sensitive silver bromide was prepared as follows:

| | | |
|---|---|---|
| A] | Benzotriazole | 12 g |
| | Isopropyl alcohol | 200 mg |
| B] | $AgNO_3$ | 17 g |
| | $H_2O$ | 50 ml |
| C] | LiBr | 2.1 g |
| | Ethanol | 20 ml |

Solution B was added to Solution A at a temperature of 40° C. with stirring. As a result, Solution A became turbid to produce a silver salt of benzotriazole.

Solution C was then added to the solution. As a result, silver was supplied from benzotriazole silver. A part of benzotriazole silver was converted to silver bromide.

The resulting powdered crystal was then filtered off. The powdered crystal thus obtained was added to a polymer solution containing 20 g of polyvinyl butyral (molecular weight: about 700) dissolved in 200 ml of iso- propyl alcohol. The solution was then subjected to dispersion in a homogenizer for 30 minutes.

A solution of 0.40 g of a dye-providing substance of the structural formula:

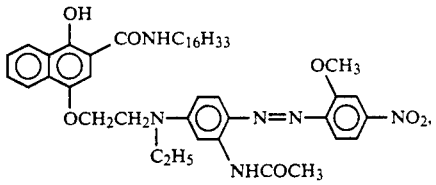

0.18 g of 2,6-dichloro-p-aminophenol as a reducing agent, 0.5 g of dimethylsulfamide as a hydrophilic heat solvent, and 0.40 g of the present base precursor (1) in 4 ml of ethyl alcohol, 8 ml of isopropyl alcohol, and 2 ml of N,N-dimethylformamide was added to 10 g of the above described benzotriazole silver emulsion containing light-sensitive silver bromide. The mixture was stirred. The solution thus obtained was then coated on a 180-μm thick polyethylene terephthalate film to a wet thickness of 100 μm. The light-sensitive material was then dried. The light-sensitive material was then imagewise exposed with light of 2,000 lux from a tungsten lamp for 10 seconds. The specimen thus imagewise exposed was uniformly heated for 60 seconds on a heat block which had been heated to a temperature of 180° C. The specimen was cooled to room temperature. The emulsion layer thus coated was then physically peeled off the polyethylene terephthalate film by means of an adhesive tape. As a result, a sharp transferred magenta negative image was obtained on the polyethylene terephthalate film. The density of the negative magenta image was measured by a Macbeth transmission densitometer (TD-504). As a result, the maximum density and the minimum density with respect to green light were 1.52 and 0.18, respectively.

EXAMPLE 2

An emulsion for a 1st layer was prepared as follows:

600 ml of an aqueous solution containing sodium chloride and potassium bromide and an aqueous solution of silver nitrate (obtained by dissolving 0.59 mol of silver nitrate in 600 ml of water) were added to an aqueous solution of gelatin (20 g of gelatin and 3 g of sodium chloride dissolved in 1,000 ml of water, kept at a temperature of 75° C.) simultaneously at the same flow rate for 40 minutes while the latter was thoroughly stirred. Thus, a monodisperse emulsion of cubic silver chlorobromide having an average grain size of 0.35 μm (bromine content: 80 mol%) was prepared.

The emulsion was then subjected to chemical sensitization at a temperature of 60° C. with 5 mg of sodium thiosulfate and 20 mg of 4-hydroxy-6-methyl-1,3,3a,7-tetrazaindene after being washed with water and desalted. The yield of the emulsion was 600 g.

An emulsion for a 3rd layer was prepared as follows:

600 ml of an aqueous solution containing sodium chloride and potassium bromide, an aqueous solution of silver nitrate (obtained by dissolving 0.59 mol of silver nitrate in 600 ml of water), and a dye solution (I) shown below were added to an aqueous solution of gelatin (20 g of gelatin and 3 g of sodium chloride dissolved in 1,000 ml of water, kept at a temperature of 75° C.) simultaneously at the same flow rate for 40 minutes while the latter was thoroughly stirred. Thus, a monodisperse emulsion of cubic silver chlorobromide having an average grain size of 0.35 μm (bromine content: 80 mol%) was prepared. After being washed with water and desalted, the emulsion thus obtained was then subjected to chemical sensitization at temperature of 60° C. with 5 mg of sodium thiosulfate and 20 mg of 4-hydroxy-6-methyl-1,3,3a,7-tetrazaindene. The yield of the emulsion was 600 g.

| Dye solution (I) | |
|---|---|
| 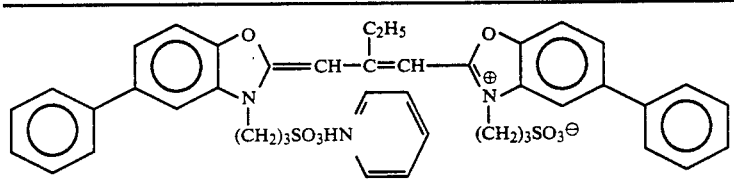 | 160 mg |
| Methanol | 400 ml |

A silver halide emulsion for a 5th layer was prepared as follows:

1,000 ml of an aqueous solution containing potassium iodide and potassium bromide and an aqueous solution of silver nitrate (obtained by dissolving 1 mol of silver nitrate in 1,000 ml of water) were added to an aqueous solution of gelatin (20 g of gelatin and ammonia dissolved in 1,000 ml of water, kept at a temperature of 50° C.) at the same time while the latter was thoroughly stirred and the pAg thereof was kept constant at 8.5. Thus, a monodisperse emulsion of octahedron silver iodobromide having an average grain size of 0.5 μm (iodine content: 5 mol%) was prepared.

After being washed with water and desalted, the emulsion was then subjected to sulfur sensitization at a temperature of 60° C. with 5 mg of chloroauric acid (tetrahydrate) and 2 mg of sodium thiosulfate. The yield of the emulsion was 1.0 kg.

The preparation of an organic silver salt is described below.

Organic silver salt (1)

A benzotriazole silver emulsion was prepared as follows:

28 g of gelatin and 13.2 g of benzotriazole were dissolved in 300 ml of water. The solution was then stirred at a temperature of 40° C. A solution of 17 g of silver nitrate in 100 ml of water was added to the solution in 2 minutes.

The pH value of the benzotriazole silver emulsion thus obtained was adjusted to 4.7 so that sedimentation occurred to remove excess salts therefrom. The pH of the emulsion was then adjusted to 6.30 to obtain 400 g of a benzotriazole silver emulsion.

Organic silver salt (2)

20 g of gelatin and 5.9 g of 4-acetylaminophenylpropiolic acid were dissolved in 1,000 ml of a 0.1% aqueous solution of sodium hydroxide and 200 ml of ethanol.

The solution was then stirred at a temperature of 40° C.

A solution of 4.5 g of silver nitrate in 200 ml of water was then added to the solution in 5 minutes.

The pH value of the dispersion thus obtained was adjusted to 4.0 so that sedimentation occurred to remove excess salts therefrom. The pH value of the dispersion was then adjusted to 6.3 to obtain 300 g of a dispersion of organic silver salt (2).

The preparation of a gelatin dispersion of a dye-providing substance is described below.

30 ml of ethyl acetate was added to 5 g of a yellow dye-providing substance (A), 0.2 g of an auxiliary developing agent (D), 0.2 g of a fog inhibitor (E), and 0.5 g of sodium succinic acid 2-ethylhexylester sulfonate and 10 g of triisononylphosphate as surface active agents. The mixture was then heated to a temperature of 60° C. so that dissolution was effected to prepare a uniform solution. The solution and 70 g of a 7% solution of lime-treated gelatin were then mixed with stirring. The mixture was then subjected to dispersion at 10,000 rpm in a homogenizer for 10 minutes. The resulting dispersion was later used as a dispersion of a yellow dye-providing substance.

A dispersion of a magenta dye-providing substance was prepared in the same manner as described above except that a magenta dye-providing substance (B) was used instead of the yellow dye-providing substance (A) and 7.5 g of tricresyl phosphate was used as a high boiling solvent.

A dispersion of a cyan dye-providing substance was prepared in the same manner as in the dispersion of a yellow dye-providing substance except that a cyan dye-providing substance (C) was used instead of the yellow dye-providing substance (A).

Dye-providing substance (A)

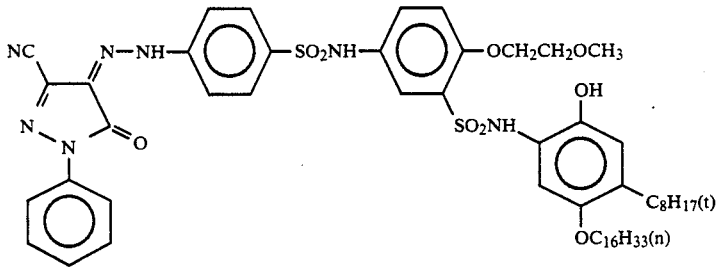

Dye-providing substance (B)

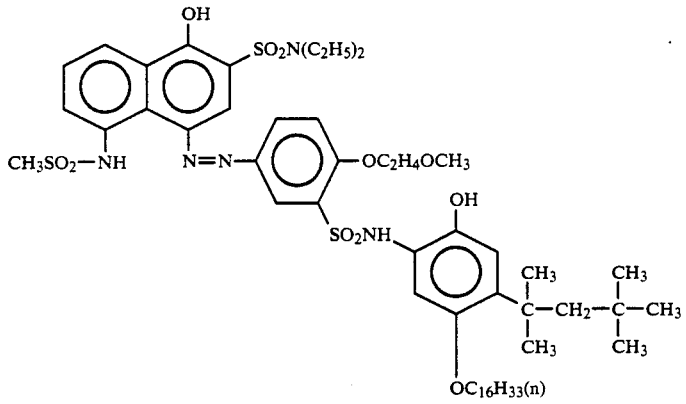

Dye-providing substance (C)

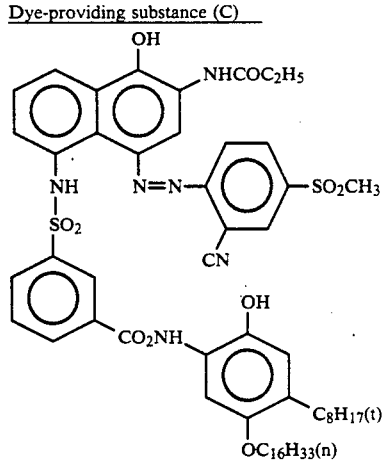

-continued

Auxiliary developing agent (D)

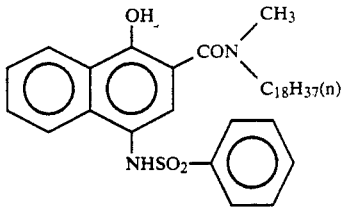

Fog inhibitor (E)

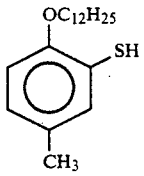

A multilayer color light-sensitive material 201 shown in Table 1 was prepared from these materials.

Further, light-sensitive materials 202 to 205 each having a similar composition as the light-sensitive material 201 were prepared in the same manner as in the light-sensitive material 201, except that the base precursor (1) was replaced by each of the based precursors shown in Table 3 in an equimolar amount, respectively.

Each of the base precursors was added as a fine dispersion as described in JP-A-59-174830.

TABLE 1

| | |
|---|---|
| 6th layer | Gelatin (coated amount: 800 mg/m$^2$)<br>Film hardener *6 (coated amount: 100 mg/m$^2$)<br>Silica *5 (coated amount: 100 mg/m$^2$)<br>Base precursor (1) (coated amount: 600 mg/m$^2$) |
| 5th layer (Blue-sensitive emulsion layer) | Silver iodobromide emulsion (iodine content: 5 mol %; coated amount: 400 mg silver/m$^2$)<br>Dimethylsulfamide (coated amount: 180 mg/m$^2$)<br>Organic silver salt (2) (coated amount: 100 mg silver/m$^2$)<br>Yellow dye-providing substance (A) (coated amount: 400 mg/m$^2$)<br>Gelatin (coated amount: 1,000 mg/m$^2$)<br>Auxiliary developing agent (D) coated amount: 16 mg/m$^2$)<br>High boiling solvent *4 (coated amount: 800 mg/m$^2$)<br>Surface active agent *2 (coated amount: 100 mg/m$^2$)<br>Fog inhibitor (E) (coated amount: 16 mg/m$^2$)<br>Base precursor (1) (coated amount: 300 mg/m$^2$) |
| 4th layer (Inter-layer) | Gelatin (coated amount: 1,000 mg/m$^2$)<br>Base precursor (1) (coated amount: 600 mg/m$^2$) |
| 3rd layer (Green-sensitive emulsion layer) | Silver chlorobromide emulsion (bromine content: 80 mol %; coated amount: 300 mg silver/m$^2$)<br>Dimethylsulfamide (coated amount: 180 mg/m$^2$)<br>Organic silver salt (2) (coated amount: 100 mg silver/m$^2$)<br>Magenta dye-providing substance (B) (coated amount: 400 mg/m$^2$)<br>Gelatin (coated amount: 1,000 mg/m$^2$)<br>Auxiliary developing agent (D) (coated amount: 16 mg/m$^2$)<br>High boiling solvent *1 (coated amount: 600 mg/m$^2$)<br>Surface active agent *2 (coated amount: 100 mg/m$^2$)<br>Fog inhibitor (E) (coated amount: 16 mg/m$^2$)<br>Base precursor (1) (coated amount: 300 mg/m$^2$) |
| 2nd layer | Gelatin (coated amount: 800 mg/m$^2$) |

TABLE 1-continued

| | |
|---|---|
| (Inter-layer) | Base precursor (1) (coated amount: 600 mg/m$^2$) |
| 1st layer (Red-sensitive emulsion layer) | Silver chlorobromide emulsion (bromine content: 80 mol %; coated amount: 300 mg silver/m$^2$)<br>Benzenesulfonamide (coated amount: 180 mg/m$^2$)<br>Organic silver salt (1) (coated amount: 100 mg silver/m$^2$)<br>Sensitizing dye *3 ($8 \times 10^{-7}$ mol/m$^2$)<br>Cyan dye-providing substance (C) (coated amount: 300 mg/m$^2$)<br>Gelatin (coated amount: 1,000 mg/m$^2$)<br>Auxiliary developing agent (D) (coated amount: 12 mg/m$^2$)<br>High boiling solvent *4 (coated amount: 450 mg/m$^2$)<br>Surface active agent *2 (coated amount: 100 mg/m$^2$)<br>Fog inhibitor (E) (coated amount: 12 mg/m$^2$)<br>Base precursor (1) (coated amount: 300 mg/m$^2$) |
| Support | *7 |

*1: Tricresyl phosphate

*2:

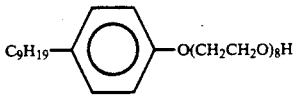

*3:

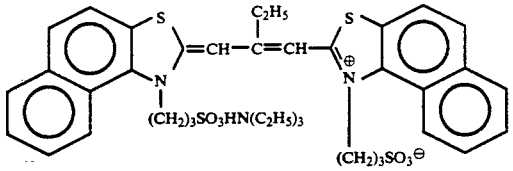

*4: $(IsoC_9H_{19}O)_3P{=}O$

*5: Size 4 μm

*6: 1,2-Bis(vinylsulfonylacetamide)ethane

*7: Polyethylene terephthalate (100 μm thick)

As a dye fixing material there was used the structure (D-1) shown in Table 2.

TABLE 2

| | |
|---|---|
| 3rd layer | Phthalated gelatin (coated amount: 1.0 g/m$^2$) |
| 2nd layer | Gelatin (coated amount: 1.5 g/m$^2$)<br>1,4-Bis(2,3-epoxypropoxy)-butane (coated amount 0.15 g/m$^2$) |
| 1st layer | Polyvinyl alcohol (polymerization degree: 2,000; coated amount 3.0 g/m$^2$)<br>Urea (coated amount: 3.5 g/m$^2$)<br>Methyl urea (coated amount: 4.5 g/m$^2$)<br>Ethylene urea (coated amount: 2.0 g/m$^2$) |

TABLE 2-continued

Dimethylsulfamide (coated amount: 2.8 g/m$^2$)
Mordant *1 (coated amount: 2.8 g/m$^2$)
Support *2

*1:

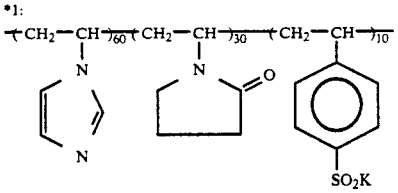

*2: Polyethylene-laminated paper

The multilayer color light-sensitive materials thus prepared were then exposed to light of 2,000 lux from a tungsten lamp through separation filters (B, G, R) having a density gradation.

Each of the light-sensitive materials thus exposed was then superposed on the dye fixing material in such a manner that the emulsion surface of the light-sensitive material and the film surface of the dye fixing material were kept in face-to-face contact with each other. The laminate was then heated for 60 seconds by a heat roller which had been adjusted so that the film temperature reached 140° C. The dye fixing material was then peeled off the light-sensitive material. As a result, a yellow image, a magenta image and a cyan image were formed on the dye fixing material in correspondence to B, G and R separation filters, respectively. These images were measured for the maximum density and minimum density by means of a Macbeth reflective densitometer (RD-519). The results are shown in Table 3.

TABLE 3

| Light-sensitive material No. | Base precursor | Maximum density | | | Minimum density | | |
|---|---|---|---|---|---|---|---|
| | | Yellow | Magenta | Cyan | Yellow | Magenta | Cyan |
| 201 | (1) | 1.92 | 2.00 | 2.05 | 0.22 | 0.20 | 0.19 |
| 202 | (3) | 1.90 | 1.98 | 2.00 | 0.22 | 0.19 | 0.19 |
| 203 | (5) | 1.98 | 2.05 | 2.11 | 0.23 | 0.21 | 0.20 |
| 204 | (23) | 1.80 | 1.95 | 2.00 | 0.20 | 0.18 | 0.18 |
| 205 | (comparative compound shown below) | 1.96 | 2.05 | 2.09 | 0.23 | 0.20 | 0.20 |

Comparative compound

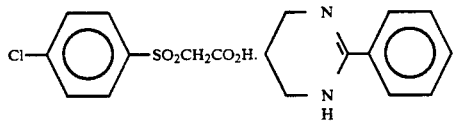

Separately, the light-sensitive materials thus prepared were stored at a temperature of 40° C. and a relative humidity of 70% for 1 week, and then processed in the same manner as described above. As a result, the light-sensitive materials 201 to 204 exhibited similar maximum densities and minimum densities to those shown in Table 3. However, the light-sensitive material 205 showed an increase about of 0.1 in minimum density. Thus, it was found that the light-sensitive material containing the present base precursor exhibited excellent preservability.

EXAMPLE 3

As an emulsion there was used the same emulsion as used in Example 2.

Gelatin dispersions of a yellow dye-providing substance, a magenta dye-providing substance, and a cyan dye-providing substance were prepared in the same manner as in Example 2 except that the dye-providing substances (A), (B), and (C) were replaced by dye-providing substances (F), (G), and (H), respectively.

A gelatin dispersion of a scavenger of an oxidation product of a developing agent was prepared by dissolving 10 g of 2,5-di(t-pentadecyl)hydroquinone and 8 g of tricresyl phosphate in 25 ml of ethyl acetate, adding 53 g of a 10% aqueous solution of gelatin, 40 ml of water and a surface active agent to the solution, and subjecting the mixture to dispersion at 10,000 rpm in a homogenizer for 10 minutes.

Dye-providing substance (F)

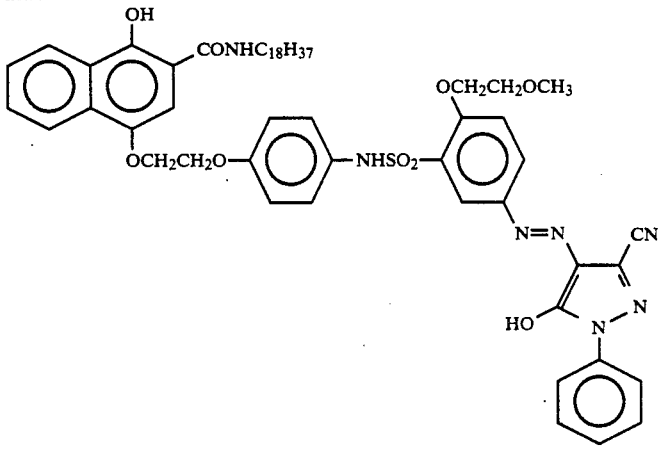

-continued

Dye-providing substance (G)

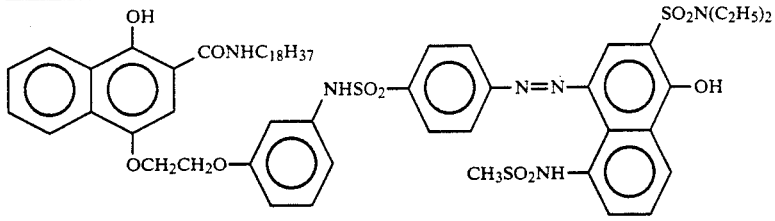

Dye-providing substance (H)

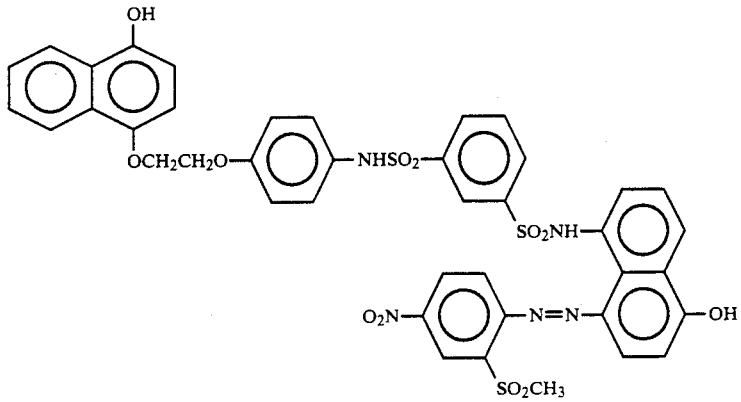

A multilayer color light-sensitive material shown in Table 4 was prepared from these materials. As a dye fixing material there was used (D-1) shown in Example 2. A yellow image, a magenta image and a cyan image were obtained in the same manner as in Example 2. The maximum density and minimum density of these images were as follows:

| | Maximum density | Minimum density |
|---|---|---|
| Yellow | 1.80 | 0.28 |
| Magenta | 1.95 | 0.26 |
| Cyan | 1.98 | 0.23 |

TABLE 4

| | |
|---|---|
| 6th layer | Gelatin (coated amount: 800 mg/m$^2$)<br>Film hardener *5 (coated amount: 100 mg/m$^2$)<br>Base precursor (3) (coated amount: 600 mg/m$^2$) |
| 5th layer (Blue-sensitive emulsion layer) | Silver iodobromide emulsion (iodine content: 5 mol %; coated amount: 400 mg silver/m$^2$)<br>Organic silver salt (1) (coated amount: 50 mg silver/m$^2$)<br>Organic silver salt (2) (coated amount: 50 mg silver/m$^2$)<br>2,6-Dichloro-p-aminophenol (coated amount: 78 mg/m$^2$)<br>Yellow dye-providing substance (F) (coated amount: 480 mg/m$^2$)<br>Gelatin (coated amount: 1,000 mg/m$^2$)<br>High boiling solvent *4 (coated amount: 240 mg/m$^2$)<br>Dimethylsulfamide (coated amount: 200 mg/m$^2$)<br>Surface active agent *2 (coated amount: 100 mg/m$^2$) |
| 4th layer (Inter-layer) | Gelatin (coated amount: 800 mg/m$^2$)<br>Base precursor (3) (coated amount: 600 mg/m$^2$)<br>2,5-Di(t-pentadecyl)hydroquinone (coated amount: 400 mg/m$^2$)<br>High boiling solvent *1 (coated amount: 320 mg/m$^2$) |
| 3rd layer (Green-sensitive emulsion layer) | Silver chlorobromide emulsion (bromine content: 80 mol %; coated amount: 300 mg silver/m$^2$)<br>Organic silver salt (1) (coated amount: 40 mg silver/m$^2$)<br>Organic silver salt (2) (coated amount: 60 mg silver/m$^2$)<br>Dimethylsulfamide (coated amount: 200 mg/m$^2$)<br>2,6-Dichloro-p-aminophenol (coated amount: 58 mg/m$^2$)<br>Magenta dye-providing substance (G) (coated amount: 400 mg/m$^2$)<br>Gelatin (coated amount: 1,000 mg/m$^2$)<br>High boiling solvent *1 (coated amount: 200 mg/m$^2$)<br>Surface active agent *2 (coated amount: 100 mg/m$^2$) |
| 2nd layer (Inter-layer) | Gelatin (coated amount: 800 mg/m$^2$)<br>Base precursor (3) (coated amount: 600 mg/m$^2$)<br>2,5-Di(t-pentadecyl)hydroquinone (coated amount: 400 mg/m$^2$)<br>High boiling solvent *4 (coated amount: 320 mg/m$^2$) |
| 1st layer (Red-sensitive emulsion layer) | Silver chlorobromide emulsion (bromine content: 80 mol %; coated amount: 300 mg silver/m$^2$)<br>2,6-Dichloro-p-aminophenol (coated amount: 46 mg/m$^2$)<br>Organic silver salt (1) (coated amount: 20 mg silver m$^2$)<br>Organic silver salt (2) (coated amount: 80 mg silver m$^2$)<br>Sensitizing dye *3 ($8 \times 10^{-7}$ mol/m$^2$)<br>Cyan dye-providing substance (H) (coated amount: 300 mg/m$^2$)<br>Gelatin (coated amount: 1,000 mg/m$^2$)<br>Dimethylsulfamide (coated amount: 200 mg/m$^2$)<br>High boiling solvent *4 (coated amount: 150 mg/m$^2$)<br>Surface active agent *2 (coated amount: 100 mg/m$^2$) |

TABLE 4-continued

| Support | *6 |
|---|---|

*1: Tricresyl phosphate

*2: $C_9H_{19}$—$O(CH_2CH_2O)_8H$

*3:

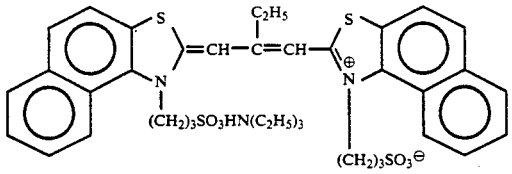

*4: $(IsoC_9H_{19}O)_3P{=}O$
*5: 1,2-Bis(vinylsulfonylacetamide)ethane
*6: Polyethylene terephthalate (100 μm thick).

EXAMPLE 4

As an emulsion there was used the same emulsion as used in Example 2.

The preparation of a gelatin dispersion of a dye-providing substance is described below.

5 g of a yellow dye-providing substance (L), 4.8 g of a reducing agent (K) and 5 g of tricresyl phosphate was dissolved in 11 ml of cyclohexanone under heating to 60° C. to prepare a uniform solution. 26 g of a 7% solution of lime-treated gelatin was added to the solution with stirring. The mixture was then subjected to dispersion at 10,000 rpm in a homogenizer for 10 minutes.

Dispersions of a magenta dye-providing substance and a cyan dye-providing substance were prepared in the same manner as described above except that 4.8 g of a magenta dye-providing substance (M) and 4 g of a cyan dye-providing substance (N) were used, respectively, instead of the yellow dye-providing substance.

As a gelatin dispersion of a scavenger of an oxidation produce of a developing agent there was used the same dispersion as used in Example 3.

Dye-providing substance (L)

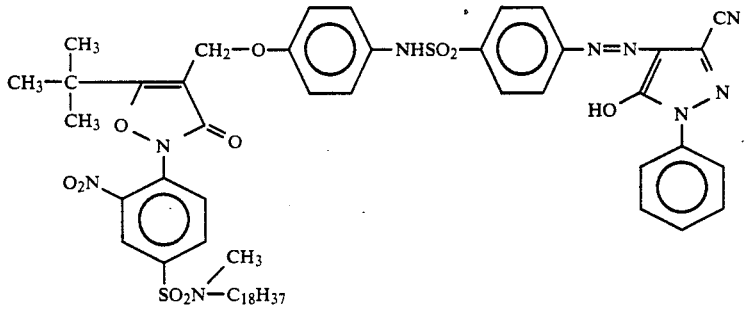

Dye-providing substance (M)

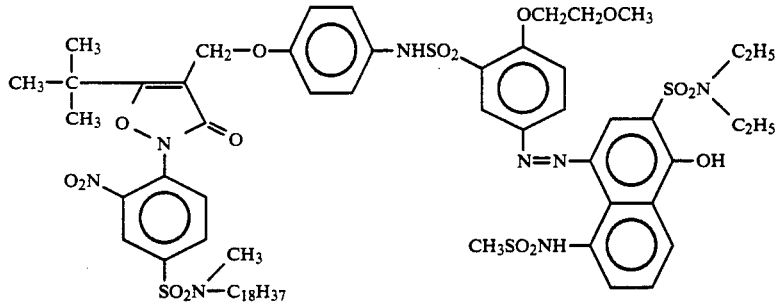

Dye-providing substance (N)

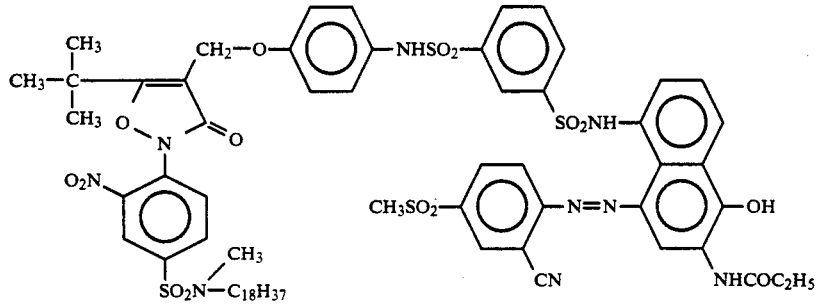

Reducing agent (K)

-continued

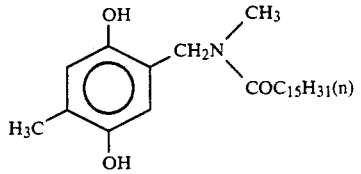

A multilayer color light-sensitive material 401 shown in Table 5 was prepared from these materials. A light-sensitive material 402 having a similar composition as the light-sensitive material 401 was prepared in the same manner as in the light-sensitive material 401, except that the base precursor (26) was replaced by the undermentioned comparative compound in an equimolar amount.

Comparative compound

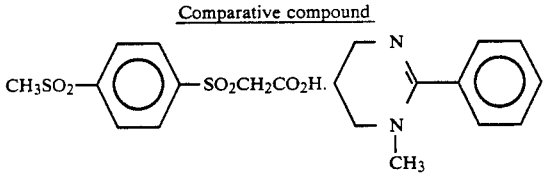

TABLE 5

| | |
|---|---|
| 7th layer (Reflective layer) | Gelatin (coated amount: 2,500 mg/m$^2$)<br>Titanium white ($TiO_2$, coated amount: 16 mg/m$^2$) |
| 6th layer (Protective layer) | Gelatin (coated amount: 400 mg/m$^2$)<br>Base precursor (26) (coated amount: 650 mg/m$^2$) |
| 5th layer (Red-sensitive emulsion layer) | Silver chlorobromide emulsion (bromine content: 80 mol %; coated amount: 300 mg silver/m$^2$)<br>Organic silver salt (1) (coated amount: 100 mg silver/m$^2$)<br>Cyan dye-providing substance (N) (coated amount: 400 mg/m$^2$)<br>Reducing agent (K) (coated amount: 400 mg/m$^2$)<br>Auxiliary developing agent *1 (coated amount: 45 mg/m$^2$)<br>High boiling solvent *2 (coated amount: 500 mg/m$^2$)<br>Gelatin (coated amount: 800 mg/m$^2$)<br>Dimethylsulfamide (coated amount: 200 mg/m$^2$)<br>Surface active agent *3 (coated amount: 100 mg/m$^2$) |
| 4th layer (Inter-layer) | Gelatin (coated amount: 500 mg/m$^2$)<br>2,5-Di(t-pentadecyl)hydroquinone (coated amount: 400 mg/m$^2$)<br>High boiling solvent *2 (coated amount: 320 mg/m$^2$)<br>Base precursor (26) (coated amount: 650 mg/m$^2$) |
| 3rd layer (Green-sensitive emulsion layer) | Silver chlorobromide emulsion (bromine content: 80 mol %; coated amount: 300 silver/m$^2$)<br>Organic silver salt (1) (coated amount: 100 mg silver/m$^2$)<br>Magenta dye-providing substance (M) (coated amount: 480 mg/m$^2$)<br>Reducing agent (K) (coated amount: 400 mg/m$^2$)<br>Auxiliary developing agent *1 (coated amount: 45 mg/m$^2$)<br>High boiling solvent *2 (coated amount: 500 mg/m$^2$)<br>Gelatin (coated amount: 800 mg/m$^2$)<br>Dimethylsulfamide (coated amount: 200 mg/m$^2$)<br>Surface active agent *3 (coated amount: 100 mg/m$^2$) |
| 2nd layer (Inter-layer) | Gelatin (coated amount: 500 mg/m$^2$)<br>2,5-Di(t-pentadecyl)hydroquinone (coated amount: 400 mg/m$^2$) |

TABLE 5-continued

| | |
|---|---|
| | High boiling solvent *2 (coated amount: 320 mg/m$^2$)<br>Base precursor (26) (coated amount: 650 mg/m$^2$) |
| 1st layer (Blue-sensitive emulsion layer) | Silver iodobromide emulsion (iodine content: 5 mol %; coated amount: 400 mg silver/m$^2$)<br>Organic silver salt (1) (coated amount: 100 mg silver/m$^2$)<br>Yellow dye-providing substance (L) (coated amount: 500 mg/m$^2$)<br>Reducing agent (K) (coated amount: 400 mg/m$^2$)<br>Auxiliary developing agent *1 (coated amount: 45 mg/m$^2$)<br>High boiling solvent *2 (coated amount: 500 mg/m$^2$)<br>Gelatin (coated amount: 800 mg/m$^2$)<br>Dimethylsulfamide (coated amount: 200 mg/m$^2$)<br>Surface active agent *3 (coated amount: 100 mg/m$^2$) |
| Support | *4 |

*1:

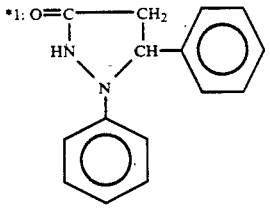

*2: Tricresyl phosphate

*3:

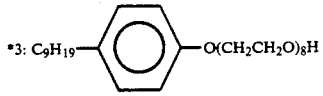

*4: Polyethylene terephthalate (100 μm thick)

The preparation of a dye fixing material is described below.

3.5 g of urea, 4.5 g of methyl urea, 2.0 g of ethylene urea, 2.0 g of dimethylsulfamide, and 20 ml of a 15% aqueous solution of a mordant of the undermentioned structural formula were added to and dissolved in 60 ml of a 5% aqueous solution of polyvinyl alcohol (average molecular weight: 2,000). The solution was then coated on a 100-μm thick polyethylene terephthalate film to a wet thickness of 90 μm, and then dried.

Mordant

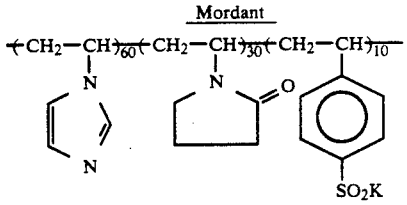

(molecular weight: about 1,000,000)

A solution of 35 g of gelatin and 2.0 g of 1,2-bis(vinylsulfonylacetamide)ethane in 800 ml of water was then coated on the thus formed layer to a wet thickness of 45 μm, and dried to prepare a dye fixing material (D-2).

The multilayer color light-sensitive material thus formed was then imagewise exposed to light from a tungsten lamp through a grey filter from the transparent support side.

The light-sensitive material thus exposed and the dye fixing material were laminated with each other in such a manner that the emulsion surface of the light-sensitive material and the film surface of the dye fixing material were kept in face-to-face contact with each other. The laminate was then heated for 50 seconds by a heat roller which had been adjusted so that the film temperature reached 140° C. The observation of the laminate from the transparent support side of the dye fixing material showed that a color image had been formed on the dye fixing material in countercorrespondence to the grey filter. The maximum density and minimum density of each color image were as follows:

| | Light-sensitive material 401 (present invention) | | Light-sensitive material 402 (comparison) | |
|---|---|---|---|---|
| | Maximum density | Minimum density | Maximum density | Minimum density |
| Yellow | 1.80 | 0.28 | 1.92 | 0.28 |
| Magenta | 1.96 | 0.25 | 2.00 | 0.26 |
| Cyan | 2.10 | 0.26 | 2.11 | 0.28 |

Separately, the light-sensitive materials were stored at a temperature of 40° C. and a relative humidity of 70% for 1 week, and then processed in the same manner as described above. The results showed that the light-sensitive material 401 exhibited the similar maximum density and minimum density as shown in the above table while the light-sensitive material 402 showed an increase of about 0.15 in the minimum density. Thus, it was found that the light-sensitive material of the present invention exhibited excellent preservability.

EXAMPLE 5

The preparation of a dye fixing material (D-3) is described below.

10 g of poly(methyl acrylate-co-N,N,N-trimethyl-N-vinylbenzylammonium chloride) (ratio of methyl acrylate to vinylbenzylammonium chloride: 1:1, molecular weight: about 900,000) was dissolved in 200 ml of water. The aqueous solution thus prepared was then uniformly mixed with 100 g of 10% lime-treated gelatin. The mixed solution thus obtained was then uniformly coated on a polyethylene-laminated paper support to a wet thickness of 90 μm.

A solution obtained by mixing 16 ml of water, 20 g of 10% gelatin, 48 ml of a 1% aqueous solution of sodium succinic acid-2-ethyl-hexylester sulfonate, and 2 ml of a 2% aqueous solution of 1,2-bis(vinylsulfonylacetamide)ethane was then coated on the layer thus formed to a wet thickness of 30 μm, and dried to prepare a dye fixing material (D-3) having a mordant layer.

The light-sensitive materials 201 to 205 in Example 2 and the light-sensitive materials 401 and 402 were then imagewise exposed to light. These light-sensitive materials were then heated to a temperature of 140° C. for 20 seconds by a heat block which had been kept in contact with the film surface thereof. Water was uniformly applied to the film surface of the dye fixing material (D-3) in an amount of 20 ml/m$^2$. The light-sensitive materials thus heated were then laminated with the dye fixing material in face-to-face such a manner that the film surfaces thereof were kept in face-to-face contact with each other. The laminate was then heated for about 6 seconds through a heat roller which had been heated to a temperature of 100° C. As a result, a sharp color image was formed on the dye fixing material. Thus, it was found that the light-sensitive materials of the present invention were useful for a process including transfer of a dye produced by heat development to a dye fixing material by using water.

The present invention provides a heat developable light-sensitive material which exhibits an excellent age preservability and provides a high S/N ratio image density.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon at least one layer containing a base precursor, a light-sensitive silver halide, a binder, and a dye-providing substance which produces or releases a diffusible dye in correspondence or countercorrespondence to the reduction of the light-sensitive silver halide to silver at an elevated temperature, said base precursor comprising a salt of a carboxylic acid and a diacidic, triacidic or tetraacidic organic base comprising a hydrocarbon group or a heterocyclic group substituted with 2 to 4 amidine groups, said amidine group substituents being obtained by removing a hydrogen atom from a group represented by formula (I-2):

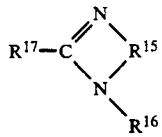

(I-2)

wherein $R^{15}$ represents a substituted or unsubstituted divalent group selected from the group consisting of an ethylene group, a propylene group and a propenylene group; and $R^{16}$ and $R^{17}$, which may be the same or different, each represents hydrogen or a substituted or unsubstituted monovalent group selected from the group consisting of an alkyl group, an alkenyl group, an alkynyl group, a cycloalkyl group, an aralkyl group, an aryl group and a heterocyclic group.

2. The heat developable light-sensitive material as claimed in claim 1, wherein said organic base is represented by formula (II):

$$R^5\text{-}(B)_n \qquad \text{(II)}$$

wherein $R^5$ represents a hydrocarbon group or a heterocyclic group; B represents said amidine represented by formula (I-2); and n is an integer of 2 to 4.

3. The heat developable light-sensitive material as claimed in claim 1, wherein $R^{15}$ represents an ethylene group or a propylene group; $R^{16}$ represents hydrogen, a substituted alkyl group or an unsubstituted alkyl group; and $R^{17}$ represents hydrogen.

4. The heat developable light-sensitive material as claimed in claim 3, wherein $R^{15}$ represents a propylene group.

5. The heat developable light-sensitive material as claimed in claim 1, wherein said amidine represented by formula (I-2) is 1,4,5,6-tetrahydropyrimidine or a derivative thereof.

6. The heat developable light-sensitive material as claimed in claim 2, wherein n is 2.

7. The heat developable light-sensitive material as claimed in claim 2, wherein said hydrocarbon group represented by $R^5$ is an alkylene group containing 1 to 6 carbon atoms or an arylene group, and said heterocyclic group represented by $R^5$ is a pyridine group.

8. The heat developable light-sensitive material as claimed in claim 2, wherein said organic base is symmetrical.

9. The heat developable light-sensitive material as claimed in claim 2, wherein said organic base is represented by formula (II-2):

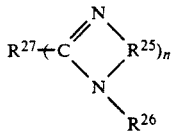

(II-2)

wherein $R^{25}$ represents a substituted or unsubstituted divalent group selected from the group consisting of an ethylene group, a propylene group, and a propenylene group; $R^{26}$ represents a substituted or unsubstituted group selected from the group consisting of hydrogen, an alkyl group, an alkenyl group, an alkynyl group, a cycloalkyl group, an aralkyl group, an aryl group, and a heterocyclic group; $R^{27}$ represents a hydrocarbon group or a heterocyclic group; and n is an integer of 2 to 4.

10. The heat developable light-sensitive material as claimed in claim 1, wherein the carboxyl group contained in said carboxylic acid undergoes decarboxylation at a temperature of 50° to 200° C.

11. The heat developable light-sensitive material as claimed in claim 10, wherein said carboxyl group contained in said carboxylic acid undergoes decarboxylation at a temperature of 80° to 100° C.

12. The heat developable light-sensitive material as claimed in claim 1, wherein said carboxylic acid comprises an aryl group or arylene group.

13. The heat developable light-sensitive material as claimed in claim 1, wherein said carboxylic acid is represented by formula (III-1):

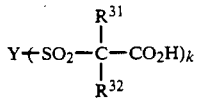

(III-1)

wherein $R^{31}$ and $R^{32}$, which may be the same or different, each represents hydrogen or a substituted or unsubstituted monovalent group selected from the group consisting of an alkyl group, an alkenyl group, an alkynyl group, a cycloalkyl group, an aralkyl group, an aryl group, and a heterocyclic group; k is an integer of 1 or 2; when k is 1, Y represents a substituted or unsubstituted monovalent group selected from the group consisting of an alkyl group, a cycloalkyl group, an alkenyl group, an alkynyl group, an aralkyl group, an aryl group, and a heterocyclic group; and when k is 2, Y represents a substituted or unsubstituted divalent group selected from the group consisting of an alkylene group, an arylene group and a heterocyclic group.

14. The heat developable light-sensitive material as claimed in claim 1, wherein said carboxylic acid is represented by formula (III-2):

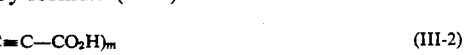

(III-2)

wherein m is an integer of 1 or 2; when m is 1, Z represents hydrogen or a substituted or unsubstituted monovalent group selected from an alkyl group, a cycloalkyl group, an alkenyl group, an alkynyl group, an aralkyl group, an aryl group, a heterocyclic group and a carboxyl group; and when m is 2, Z represents a substituted or unsubstituted divalent group selected from the group consisting of an alkylene group, an arylene group and a heterocyclic group.

15. The heat developable light-sensitive material as claimed in claim 1, wherein the melting point of the salt of said carboxylic acid and said organic base is from 50° to 200° C.

16. The heat developable light-sensitive material as claimed in claim 15, wherein the melting point of said salt of said carboxylic acid and said organic base is from 80° to 160° C.

17. The heat developable light-sensitive material as claimed in claim 1, wherein said base precursor is present in an amount of from 0.01 to 40% by weight of the total dry weight of all coated layers of said light-sensitive material.

* * * * *